US009058967B2

(12) United States Patent
Ouyang et al.

(10) Patent No.: US 9,058,967 B2
(45) **Date of Patent: *Jun. 16, 2015**

(54) DISCONTINUOUS ATMOSPHERIC PRESSURE INTERFACE

(71) Applicant: Purdue Research Foundation, West Lafayette, IN (US)

(72) Inventors: Zheng Ouyang, West Lafayette, IN (US); Liang Gao, West Lafayette, IN (US); Robert Graham Cooks, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/478,529

(22) Filed: Sep. 5, 2014

(65) Prior Publication Data

US 2015/0034818 A1 Feb. 5, 2015

Related U.S. Application Data

(63) Continuation of application No. 14/227,563, filed on Mar. 27, 2014, now Pat. No. 8,853,627, which is a continuation of application No. 13/633,281, filed on Oct. 2, 2012, now Pat. No. 8,766,178, which is a (Continued)

(51) Int. Cl.
*H01J 49/04* (2006.01)
*H01J 49/10* (2006.01)
(Continued)

(52) U.S. Cl.
CPC ..... *H01J 49/24* (2013.01); *H01J 49/26* (2013.01); *H01J 49/0031* (2013.01); *H01J 49/0013* (2013.01); *H01J 49/165* (2013.01); *H01J 49/004* (2013.01)

(58) Field of Classification Search
CPC ..... H01J 49/0013; H01J 49/0031; H01J 49/0422; H01J 49/10; H01J 49/24
USPC ..... 250/281–300
See application file for complete search history.

(56) References Cited

U.S. PATENT DOCUMENTS 3,895,231 A 7/1975 Sodal et al.
RE33,863 E 3/1992 Bowman et al.
(Continued)

FOREIGN PATENT DOCUMENTS

EP 08124518 5/1996
EP 09210965 8/1997
(Continued)

OTHER PUBLICATIONS

Kwang et al., A review of microvalves, Journal of Micromechanics and Microenfineering Mar. 24, 2006,16:R13-R39.
International Preliminary Report on Patentability mailed Dec. 10, 2009 PCTUS2008065245.
(Continued)

*Primary Examiner* — Jack Berman
(74) *Attorney, Agent, or Firm* — Brown Rudnick LLP; Adam M. Schoen

(57) ABSTRACT

A method of interfacing atmospheric pressure ion sources, including electrospray and desorption electrospray ionization sources, to mass spectrometers, for example miniature mass spectrometers, in which the ionized sample is discontinuously introduced into the mass spectrometer. Discontinuous introduction improves the match between the pumping capacity of the instrument and the volume of atmospheric pressure gas that contains the ionized sample. The reduced duty cycle of sample introduction is offset by operation of the mass spectrometer under higher performance conditions and by ion accumulation at atmospheric pressure.

18 Claims, 30 Drawing Sheets

Related U.S. Application Data continuation of application No. 12/622,776, filed on Nov. 20, 2009, now Pat. No. 8,304,718, which is a continuation-in-part of application No. PCT/US2008/065245, filed on May 30, 2008.

(60) Provisional application No. 60/941,310, filed on Jun. 1, 2007, provisional application No. 60/953,822, filed on Aug. 3, 2007, provisional application No. 61/254,086, filed on Oct. 22, 2009.

(51) Int. Cl.

| | |
|---|---|
| ***H01J 49/24*** | (2006.01) |
| ***H01J 49/00*** | (2006.01) |
| ***H01J 49/26*** | (2006.01) |
| ***H01J 49/16*** | (2006.01) |

(56) References Cited

U.S. PATENT DOCUMENTS

| | | | | |
|---|---|---|---|---|
| 5,436,446 | A | 7/1995 | Jarrell et al. | |
| 5,689,111 | A | 11/1997 | Dresch et al. | |
| 5,756,995 | A | 5/1998 | Maswadeh et al. | |
| 5,856,671 | A | 1/1999 | Henion et al. | |
| 6,040,575 | A | 3/2000 | Whitehouse et al. | |
| 6,121,609 | A | 9/2000 | Littlejohn | |
| 6,396,057 | B1 | 5/2002 | Jarrell et al. | |
| 6,501,073 | B1 | 12/2002 | Mylchreest et al. | |
| 6,518,581 | B1 | 2/2003 | Dheandhanoo et al. | |
| 6,570,152 | B1 | 5/2003 | Hoyes | |
| 6,777,672 | B1 | 8/2004 | Park | |
| 8,304,718 | B2 * | 11/2012 | Ouyang et al. | 250/288 |
| 8,680,464 | B2 | 3/2014 | Hashimoto et al. | |
| 8,766,178 | B2 * | 7/2014 | Ouyang et al. | 250/288 |
| 8,853,627 | B2 * | 10/2014 | Ouyang et al. | 250/288 |
| 2002/0092979 | A1 | 7/2002 | McCauley et al. | |
| 2002/0121598 | A1 | 9/2002 | Park | |
| 2003/0020013 | A1 | 1/2003 | Sakairi | |
| 2005/0269518 | A1 | 12/2005 | Bajic et al. | |
| 2006/0054805 | A1 | 3/2006 | Flanagan et al. | |
| 2007/0018093 | A1 | 1/2007 | Earm et al. | |
| 2013/0056633 | A1 | 3/2013 | Hashimoto et al. | |
| 2013/0146759 | A1 | 6/2013 | Ouyang et al. | |
| 2013/0280819 | A1 | 10/2013 | Cooks et al. | |
| 2014/0051180 | A1 | 2/2014 | Cooks et al. | |
| 2014/0138540 | A1 | 5/2014 | Ouyang et al. | |

FOREIGN PATENT DOCUMENTS

| | | | |
|---|---|---|---|
| WO | 2005/096720 | A2 | 10/2005 |
| WO | 2009/023361 | A2 | 2/2009 |

OTHER PUBLICATIONS

Gao et al., Breaking the Pumping Speed Barrier in Mass Spectrometry; Discontinuous Atmosheric Pressure Interface, Jun. 1, 2008 80:11 4026-4032.

Carroll, D. I.; Dzidic, I.; Stillwell, R. N.; Haegele, K. D.; Horning, E. C. Anal. Chem. 1975, 47, 2369-2373.

Chen, H.; Ouyang, Z.; Cooks, R. G. Angewandte Chemie, International Edition 2006, 45, 3656-3660.

Chen, H.; Eberlin, L. S.; Cooks, R. G. Journal of the American Chemical Society 2007, 129, 5880-5886.

Cody, R. B.; Laramee, J. A.; Durst, H. D. Anal. Chem. 2005, 77, 2297-2302.

Fenn, J. B.; Mann, M.; Meng, C. K.; Wong, S. F.; Whitehouse, C. M. Science 1989, 246, 64-71.

Gao, L.; Song, Q.; Patterson, G. E.; Cooks, R. G.; Ouyang, Z. Anal. Chem. 2006, 78, 5994-6002.

Grim, D. M.; Siegel, J.; Allison, J. J. Forensic Sci. 2002, 47, 1265-1273.

Written Opinion of the International Searching Authority as mailed on Mar. 25, 2009 in corresponding PCT application PCT/US2008/065245.

Hawkridge, A. M.; Zhou, L.; Lee, M. L.; Muddiman, D. C. Analytical Chemistry 2004, 76, 4118-4122.

Ifa, D. R.; Gumaelius, L. M.; Eberlin, L. S.; Manicke, N. E.; Cooks, R. G. Analyst 2007, 132, 461-467.

International Search Report as mailed on Mar. 25, 2009 in corresponding PCT application PCT/US2008/065245.

Laiko, V. V.; Baldwin, M. A.; Burlingame, A. L. Anal. Chem. 2000, 72, 652-657.

Laughlin, B. C.; Mulligan, C. C.; Cooks, R. G. Anal. Chem. 2005, 77, 2928-2939.

Loo, R. R. O.; Udseth, H. R.; Smith, R. D. Journal of the American Society for Mass Spectrometry 1992, 3, 695-705.

Pan, P.; Gunawardena, H. P.; Xia, Y.; Mckuckey, S. A. Anal. Chem. 2004, 76, 1165-1174.

Shaffer, S.A. et al., Rapid Communicationas in Mass Spectrometry, 1997, 11, p. 1813-1817.

Shaffer, S. A.; Tang, K. Q.; Anderson, G. A.; Prior, D. C.; Udseth, H. R.; Smith, R. D. Rapid Communications in Mass Spectrometry 1997, 11, 1813-1817.

Tanaka, K.; Waki, H.; Ido, Y.; Akita, S.; Yoshida, Y.; Yoshida, T.; Matsuo, T. Rapid Commun. Mass Spectrom. 1988, 2, 151-153.

Takats, Z.; Cooks, R. G. Chemical Communications (Cambridge, United Kingdom) 2004, 444-445.

Takats, Z.; Wiseman, J. M.; Gologan, B.; Cooks, R. G. Science 2004, 306, 471-473.

Zhou, L.; Yue, B.; Dearden, D. V.; Lee, E. D.; Rockwook, A. L.; Lee, M. L. Anal. Chem. 2003, 75, 5978-5983.

* cited by examiner

I. Preionization

II. Ionization (ion transfer allowed) 15 - 30 ms

III. Cooling, 250 - 500 ms

IV. Scan, 100ms

V. Postscan

FIG. 16A
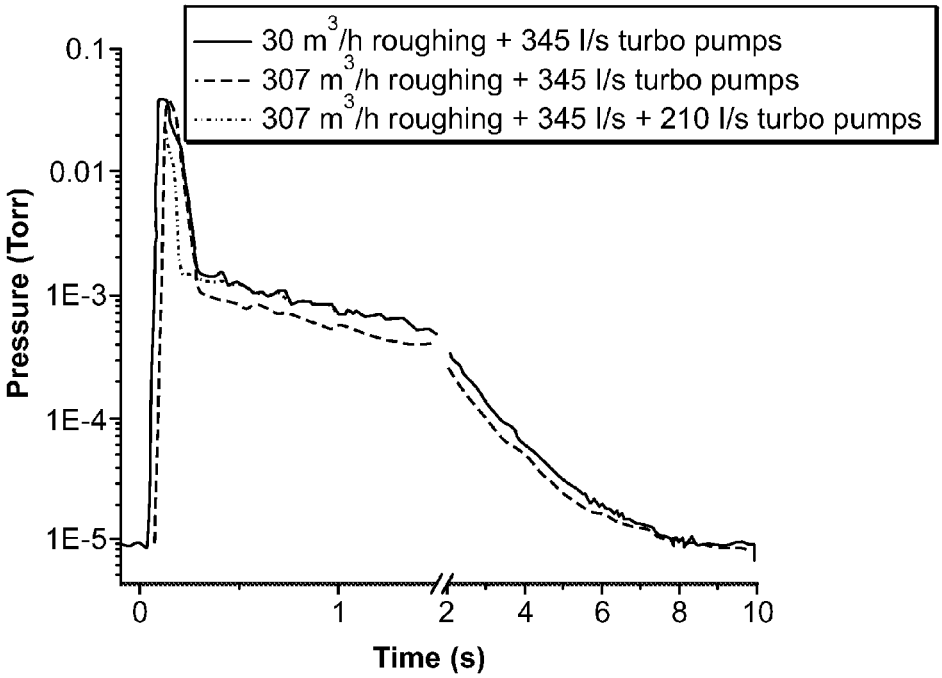
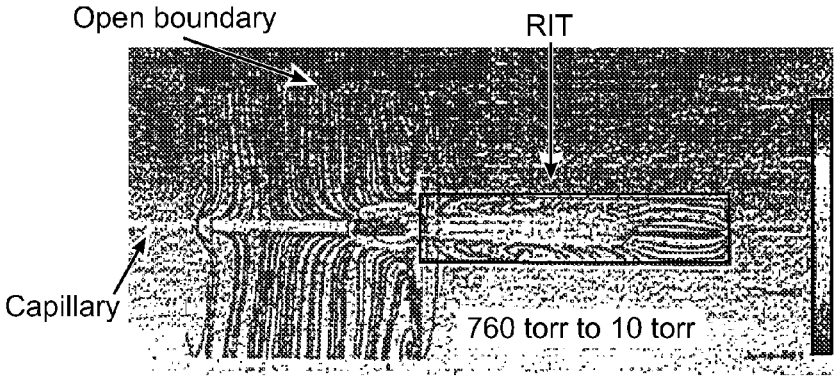
FIG. 16B
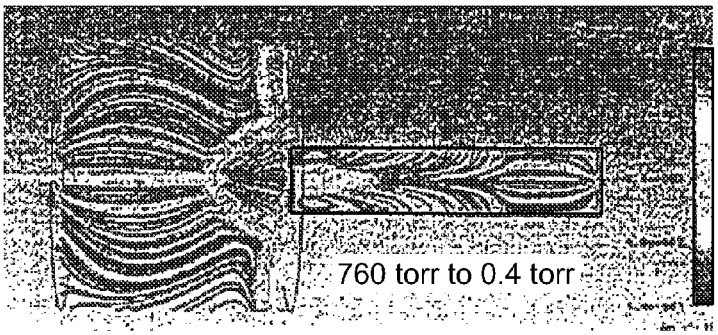
FIG. 16C

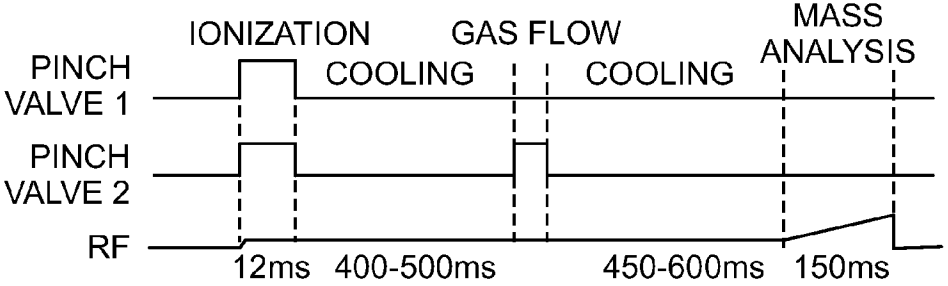
FIG. 18A
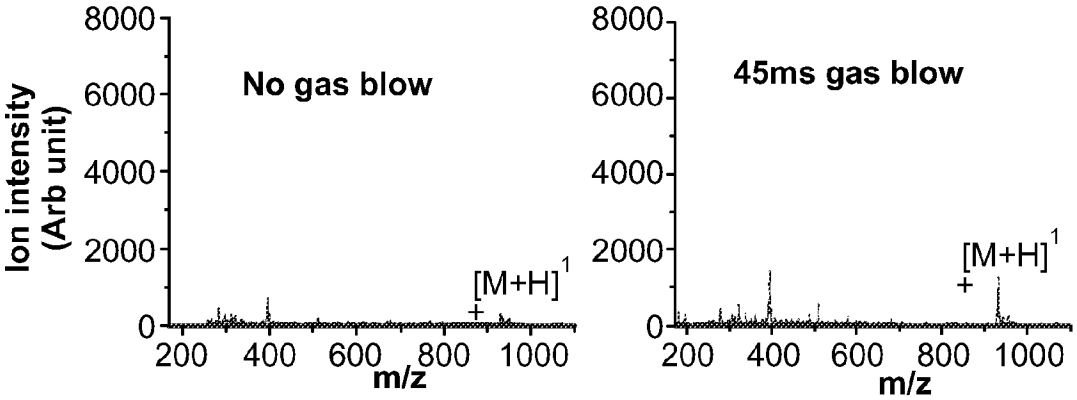
FIG. 18B
FIG. 18C
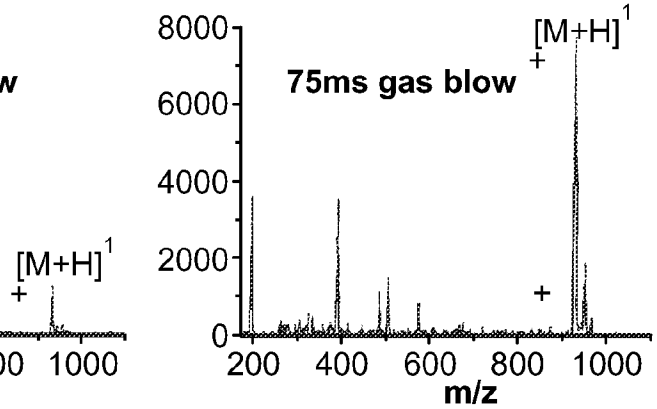
FIG. 18D

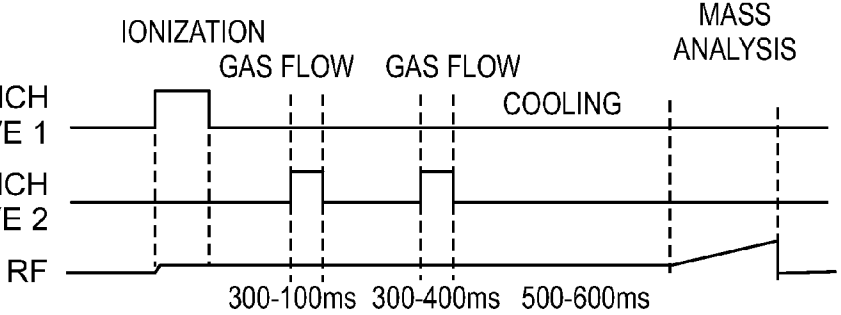
FIG. 20A
FIG. 20B
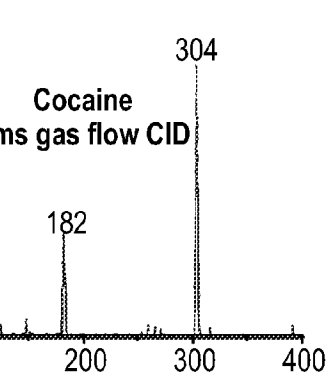
FIG. 20C
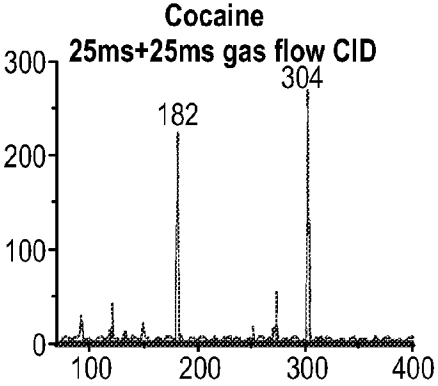
FIG. 20D

FIG. 21A
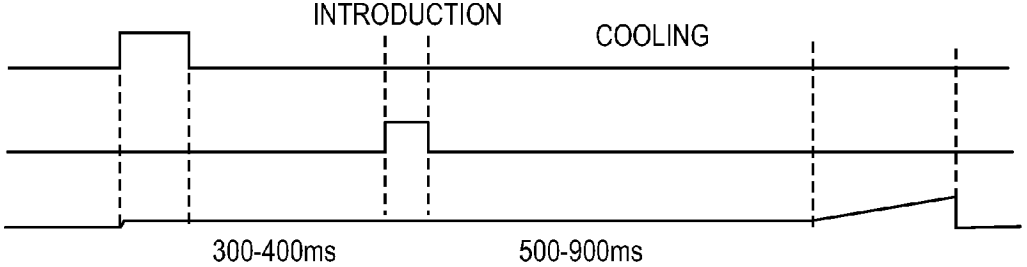
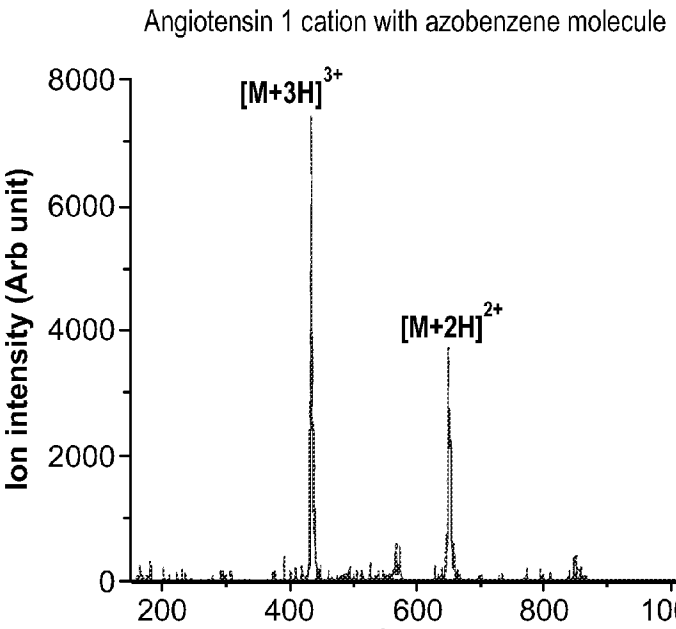
FIG. 21B
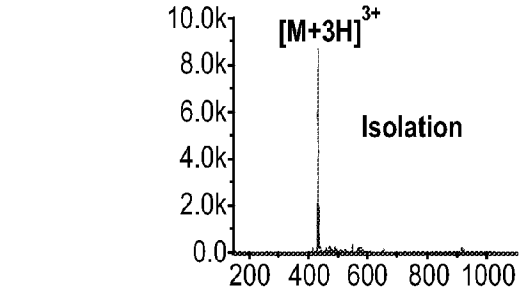
FIG. 21C

DISCONTINUOUS ATMOSPHERIC PRESSURE INTERFACE

RELATED APPLICATIONS

This application is a continuation of U.S. nonprovisional application Ser. No. 14/227,563, filed Mar. 27, 2014, which is a continuation of U.S. nonprovisional application Ser. No. 13/633,281, filed Oct. 2, 2012, which is a continuation of U.S. nonprovisional application Ser. No. 12/622,776, filed Nov. 20, 2009, which is a continuation-in-part of international patent application number PCT/US2008/065245, filed May 30, 2008, which claims priority to and the benefit of U.S. provisional application Ser. Nos. 60/941,310 and 60/953,822 filed in the U.S. Patent and Trademark office Jun. 1, 2007 and Aug. 3, 2007 respectively. U.S. nonprovisional application Ser. No. 12/622,776 also claims priority to and the benefit of U.S. provisional application Ser. No. 61/254,086, filed Oct. 22, 2009. The contents of each of which are hereby incorporated by reference herein in their entireties.

GOVERNMENT SUPPORT

This invention was made with government support under N00014-05-1-0454 awarded by the Office of Navy Research; and HSHQPA-05-9-0033 awarded by the Department of Homeland Security Advanced Research Projects Agency. The government has certain rights in the invention.

TECHNICAL FIELD

The invention generally relates to an improvement to ion introduction to mass spectrometers.

BACKGROUND

The atmospheric pressure interface (API) of a mass spectrometer is used to transfer ions from a region at atmospheric pressure into other regions at reduced pressures. It allows the development and use of a variety of ionization sources at atmospheric pressure for mass spectrometry, including electrospray ionization (ESI) (Fenn, J. B.; Mann, M.; Meng, C. K.; Wong, S. F.; Whitehouse, C. M. *Science* 1989, 246, 64-71; Yamashita, M.; Fenn, J. B. *J. Phys. Chem.* 1984, 88, 4451-4459), atmospheric pressure ionization (APCI) (Carroll, D. I.; Dzidic, I.; Stillwell, R. N.; Haegele, K. D.; Horning, E. C. *Anal. Chem.* 1975, 47, 2369-2373), and atmospheric pressure matrix assisted laser desorption ionization (AP-MALDI), (Laiko, V. V.; Baldwin, M. A.; Burlingame, A. L. *Anal. Chem.* 2000, 72, 652-657; Tanaka, K.; Waki, H.; Ido, Y.; Akita, S.; Yoshida, Y.; Yoshida, T.; Matsuo, T. *Rapid Commun. Mass Spectrom.* 1988, 2, 151-153) etc. An API not only allows the coupling of a mass spectrometer with various sample separation and sample pretreatment methods, such as liquid chromatograph, but also enables ambient preparation and treatment of ions using a variety of desirable conditions, such as the thermal production of the ions, (Chen, H.; Ouyang, Z.; Cooks, R. G. *Angewandte Chemie, International Edition* 2006, 45, 3656-3660; Takats, Z.; Cooks, R. G. *Chemical Communications* (Cambridge, United Kingdom) 2004, 444-445) ion-ion reactions (Loo, R. R. 0.; Udseth, H. R.; Smith, R. D. *Journal of the American Society for Mass Spectrometry* 1992, 3, 695-705) or ion fragmentation, (Chen, H.; Eberlin, L. S.; Cooks, R. G. *Journal of the American Chemical Society* 2007, 129, 5880-5886) before sending them into vacuum for mass analysis. Without an API, it is also not possible to take advantage of the recent development of a new category of direct ambient ionization/sampling methods, including desorption electrospray ionization (DESI) (Takats, Z.; Wiseman, J. M.; Gologan, B.; Cooks, R. G. *Science* 2004, 306, 471-473), direct analysis in real time (DART) (Cody, R. B.; Laramee, J. A.; Durst, H. D. *Anal. Chem.* 2005, 77, 2297-2302), Atmospheric Pressure Dielectric Barrier Discharge Ionization (DBDI), and electrospray-assisted laser desoption/ionization (ELDI) (Shiea, J.; Huang, M. Z.; Hsu, H. J.; Lee, C. Y.; Yuan, C. H.; Beech, I.; Sunner, J. *Rapid Commun. Mass Spectrom.* 2005, 19, 3701-3704).

Since the ESI source was first successfully demonstrated for mass spectrometry (Yamashita, M.; Fenn, J. B. *J. Phys. Chem.* 1984, 88, 4451-4459), the configuration of API used for ESI was widely adopted and has not changed significantly. Nowadays a typical API has a constantly open channel involving a series of differential pumping stages with a capillary or a thin hole of small ID to allow ions to be transferred into the first stage and a skimmer for access to the second stage. A rough pump is usually used to pump the first region to about 1 torr and multiple turbomolecular pumps or a single pump with split flow used for pumping the subsequent regions with a base pressure in the final stage used for the mass analysis, which is usually $10^{-5}$ torr or below. Ion optical systems, including static electric lenses and RF guides, are also used to preserve the ion current while the neutrals are pumped away. To maximize the number of ions transferred into the final region for mass analysis, large pumping capacities are always desirable so that larger orifices can be used to pass ions from region to region. As an example, a Finnigan LTQ (Thermo Fisher Scientific, Inc., San Jose, Calif.) ion trap mass spectormeter has two 30 $m^3$/hr rough pumps for the first stage and a 400 l/s turbomolecular pump with two drag pumping stages for the next 3 stages. The highest loss in ion transfer occur at the first stage and the second stage, corresponding to a 2 orders and a 1 order of magnitude, respectively, which results in an overall efficiency lower than 0.1% for the ion transfer through an API. When an attempt is made to implement this kind of API on a portable instrument, the ion transfer efficiency is further reduced by the fact that much lower pumping capacity must be used to achieve the desirable weight and power consumption of the instruments. A recently developed Mini 10 handheld rectilinear ion trap mass spectrometer weighs only 10 kg and has miniature rough and turbo pumps of only 0.3 $m^3$/hr and 11 l/s, respectively. (Gao, L.; Song, Q.; Patterson, G. E.; Cooks, R. G.; Ouyang, Z. *Anal. Chem.* 2006, 78, 5994-6002).

Many efforts have been made to increase the ion transfer efficiency in laboratory scale mass spectrometers. The ion transfer through the second stage has been successfully improved by a factor of ten by replacing the skimmer with an ion funnel. (Shaffer, S. A.; Tang, K. Q.; Anderson, G. A.; Prior, D. C.; Udseth, H. R.; Smith, R. D. *Rapid Communications in Mass Spectrometry* 1997, 11, 1813-1817) Air-dynamic ion focusing devices (Zhou, L.; Yue, B.; Dearden, D. V.; Lee, E. D.; Rockwook, A. L.; Lee, M. L. *Anal. Chem.* 2003, 75, 5978-5983; Hawkridge, A. M.; Zhou, L.; Lee, M. L.; Muddiman, D. C. *Analytical Chemistry* 2004, 76, 4118-4122) have been employed in front of API's of mass spectrometers. Though the efficiency of API itself was not improved, the ultimate ion current reaching the mass analyzer was significance increased. However, the possibility of arcing inside the vacuum increases at high pressure, which results in high noise and short lifetime of the electron multiplier and power supplies.

There is a need for atmospheric interfaces that increase ion transfer efficiency to a mass spectrometer.

SUMMARY

An aspect of the invention herein provides a device for controlling movement of ions and the body of air or other gas in which the ions are maintained, the device including: a valve aligned with an exterior portion of a tube, in which the valve controls movement of ions through the tube; and a first capillary inserted into a first end of the tube and a second capillary inserted into a second end of the tube, in which neither the first capillary nor the second capillary overlap with a portion of the tube that is in alignment with the valve.

In a related embodiment of the device, a proximal end of the first capillary is connected to a trapping device, in which the trapping device is below atmospheric pressure. In another related embodiment, a distal end of the second capillary receives the ions from an ionizing source, in which the ionizing source is at substantially atmospheric pressure.

In certain embodiments of the device, the tube is composed of an inert plastic, for example silicone plastic. In other embodiments, the first and second capillary are composed of an inert metal, for example stainless steel. In other embodiments of the device, the first and second capillaries have substantially the same outer diameter. In alternative embodiments, the first and second capillaries have different outer diameters. In another embodiment of the device, the first and second capillaries have substantially the same inner diameter. Alternatively, the first and second capillaries have different inner diameters. In another embodiment of the device, the second capillary has a smaller inner diameter than the inner diameter of the first capillary.

In another embodiment of the devices, the valve is selected from the group consisting of a pinch valve, a thin plate shutter valve, and a needle valve.

Another aspect of the invention herein provides a device for controlling movement of ions, the device including a valve aligned with an exterior portion of a tube, in which the valve controls movement of ions through the tube. In a related embodiment, a proximal end of the tube is connected to a trapping device, in which the trapping device is below atmospheric pressure. In another related embodiment, a distal end of the tube receives the ions from an ionizing source, in which the ionizing source is at substantially atmospheric pressure. In certain embodiment, a distal end of the tube receives the ions at a first pressure, and a proximal end of the tube is connected to a trapping device at a pressure reduced from the first pressure.

Another aspect of the invention herein provides a discontinuous atmospheric pressure interface system including: an ionizing source for converting molecules into gas phase ions in a region at about atmospheric pressure; a trapping device; and a discontinuous atmospheric pressure interface for transferring the ions from the region at about atmospheric pressure to at least one other region at a reduced pressure, in which the interface includes a valve for controlling entry of the ions into the trapping device such that the ions are transferred into the trapping device in a discontinuous mode.

In a related embodiment, the system further includes at least one vacuum pump connected to the trapping device. In another related embodiment of the system, the atmospheric pressure interface further includes: a tube, in which an exterior portion of the tube is aligned with the valve; and a first capillary inserted into a first end of the tube and a second capillary inserted into a second end of the tube, such that neither the first capillary nor the second capillary overlap with a portion of the tube that is in alignment with the valve. In another embodiment of the system, the atmospheric pressure interface further includes a tube, in which an exterior portion of the tube is aligned with the valve.

In certain embodiments of the system, ions enter the trapping device when the valve is in an open position. In another embodiment of the system, ions are prevented from entering the trapping device when the valve is in a closed position. The closed position refers to complete closure of the valve, and also includes quasi-closure of the valve, i.e, the valve is substantially closed such that pumping significantly exceeds ingress of gas or vapor. Substantially closed includes at least about 70% closed, at least about 80% closed, at least about 90% closed, at least about 95% closed, or at least about 99% closed.

In another embodiment, the system further includes a computer operably connected to the system. In another embodiment, the computer contains a processor configured to execute a computer readable program, the program controlling the position of the valve. In another embodiment, the computer contains a processor configured to execute a computer readable program, the program implementing a selected waveform inverse Fourier transformation (SWIFT) isolation algorithm to separate ions.

In certain embodiments of the system, the ionizing source operates by a technique selected from the group consisting of: electrospray ionization, nano-electrospray ionization, atmospheric pressure matrix-assisted laser desorption ionization, atmospheric pressure chemical ionization, desorption electrospray ionization, atmospheric pressure dielectric barrier discharge ionization, atmospheric pressure low temperature plasma desorption ionization, and electrospray-assisted laser desorption ionization. In another embodiment of the system, the trapping device is selected from the group consisting of a mass analyzer of a mass spectrometer, a mass analyzer of a handheld mass spectrometer, and an intermediate stage storage device.

In another embodiment of the system, the mass analyzer is selected from the group consisting of: a quadrupole ion trap, a rectalinear ion trap, a cylindrical ion trap, a ion cyclotron resonance trap, and an orbitrap. In another embodiment of the system, the intermediate storage device is coupled with a mass analyzer of a mass spectrometer or a mass analyzer of a handheld mass spectrometer. In a related embodiment, the mass analyzer is selected from the group consisting of: a mass filter, a quadrupole ion trap, a rectalinear ion trap, a cylindrical ion trap, a ion cyclotron resonance trap, an orbitrap, a time of flight mass spectrometer, and a magnetic sector mass spectrometer. In yet another embodiment, the system further includes an ion accumulating surface connected to a distal end of the second capillary. In yet another embodiment, the system further includes an ion accumulating surface connected to a distal end of the tube. In another embodiment of the system, the tube of the atmospheric interface is composed of an inert plastic, for example silicone plastic. In another embodiment of the system, the first and second capillary of the atmospheric interface are composed of an inert metal, for example stainless steel.

In certain embodiments of the system, the valve operates to control entry of ions in a synchronized manner with respect to operation of the mass analyzer. In another embodiment of the system, the configuration of the discontinuous atmospheric pressure interface and the mass analyzer is off-axis. In another embodiment of the system, an ion optical element, for example, a focusing tube lens, is located between the discontinuous atmospheric pressure interface and the mass analyzer to direct the ions into the mass analyzer. In another embodiment, the system further includes an ion optical element located between the ionization source and the discontinuous atmospheric pressure interface to direct the ions into the mass analyzer.

Another aspect of the invention provides a kit including the above devices and a container. Another aspect of the invention provides a kit including the above system and a container. In certain embodiments, the kits include instructions for use.

Another aspect of the invention provides a method of discontinuously transferring ions at atmospheric pressure into a trapping device at reduced pressure, the method including: opening a valve connected to an atmospheric pressure interface, such that opening of the valve allows for transfer of ions substantially at atmospheric pressure to a trapping device at reduced pressure; and closing the valve connected to the atmospheric pressure interface, such that closing the valve prevents additional transfer of the ions substantially at atmospheric pressure to the trapping device at reduced pressure.

In certain embodiments, prior to opening the valve, the method further includes converting molecules to gas phase ions. In other embodiments, the converting step is selected from the group consisting of: electrospray ionization, nanoelectrospray ionization, atmospheric pressure matrix-assisted laser desorption ionization, atmospheric pressure chemical ionization, desorption electrospray ionization, atmospheric pressure dielectric barrier discharge ionization, atmospheric pressure low temperature plasma desorption ionization, and electrospray-assisted laser desorption ionization.

In another embodiment of the method, the opening and the closing of the valve is controlled by a computer operably connected to the atmospheric pressure interface. In another embodiment of the method, the trapping device is selected from the group consisting of a mass analyzer of a mass spectrometer, a mass analyzer of a handheld mass spectrometer, and an intermediate stage storage device. In another embodiment of the method, the mass analyzer is selected from the group consisting of: a quadrupole ion trap, a rectalinear ion trap, a cylindrical ion trap, a ion cyclotron resonance trap, and an orbitrap. In another embodiment of the method, the intermediate storage device is coupled with a mass analyzer of a mass spectrometer or a mass analyzer of a handheld mass spectrometer. In a related embodiment, the mass analyzer is selected from the group consisting of: a mass filter, a quadrupole ion trap, a rectalinear ion trap, a cylindrical ion trap, a ion cyclotron resonance trap, an orbitrap, a time of flight mass spectrometer, and a magnetic sector mass spectrometer.

In certain embodiments of the method, electrical voltage of the mass analyzer is set to ground when the valve is open. In other embodiments of the method, subsequent to the ions being transferred into the mass analyzer and the valve being closed, the ions are retained by the mass analyzer for further manipulation. In another embodiment of the method, prior to further manipulation, the ions are cooled and the pressure is further reduced. In yet another embodiment of the method, further manipulation includes mass analysis of the ions.

In certain embodiments of the method, the computer synchronizes the opening and the closing of the valve with a sequence of mass analysis of the ions in the mass analyzer. In a related embodiment of the method, the computer synchronizes the opening and the closing of the valve with a sequence of steps that allow tandem mass analysis of the ions in the mass analyzer.

In another embodiment of the method, the atmospheric pressure interface further includes: a tube, in which an exterior portion of the tube is aligned with the valve; and a first capillary inserted into a first end of the tube and a second capillary inserted into a second end of the tube, such that neither the first capillary nor the second capillary overlap with a portion of the tube that is in alignment with the valve. In another embodiment of the method, the atmospheric pressure interface further includes: a tube, in which an exterior portion of the tube is aligned with the valve. In related embodiments of the method, the valve is selected from the group consisting of a pinch valve, a thin shutter plate valve, and a needle valve.

In another embodiment of the method, after converting the molecules to ions, the ions are stored on a functional surface connected to the distal end of the second capillary at atmospheric pressure, in which the functional surface is continuously supplied with ions from a continuously operated ion source. In another embodiment of the method, after converting the molecules to ions, the ions are stored on a functional surface connected to the distal end of the tube at atmospheric pressure, in which the functional surface is continuously supplied with ions from a continuously operated ion source. In related embodiments, the ions stored on the functional surface are subsequently transferred by the atmospheric pressure interface to the trapping device.

In another embodiment of the method, the first and second capillary of the atmospheric interface have substantially the same outer diameter. Alternatively, the first and second capillary of the atmospheric interface have different outer diameters. In another embodiment of the method, the first and second capillary of the atmospheric interface have substantially the same inner diameter. Alternatively, the first and second capillary of the atmospheric interface have different inner diameters. In another embodiment of the method, the second capillary has a smaller inner diameter that the inner diameter of the first capillary.

Another aspect of the invention provides a method of discontinuously transferring ions into a mass spectrometer, the method including: opening a valve connected to an atmospheric pressure interface, such that opening of the valve allows for transfer of ions substantially at atmospheric pressure to a mass analyzer at a reduced pressure in the mass spectrometer; and closing the valve connected to the atmospheric pressure interface, such that closing the valve prevents additional transfer of the ions substantially at atmospheric pressure to the mass analyzer at the reduced pressure in the mass spectrometer.

In a related embodiment of the device, two devices for controlling the movement of ions and the body of air or other gas in which the ions are maintained are present: a first valve is aligned with an exterior portion of a first tube, in which the first valve controls movement of ions through the first tube; and a first capillary inserted into a first end of the tube in which the first capillary does not overlap with a portion of the first tube that is in alignment with the first valve, and a second valve aligned with an exterior portion of a second tube, in which the second valve controls movement of ions through the second tube; and a second capillary inserted into a first end of the second tube and a third capillary inserted into a second end of the second tube, in which neither the second capillary nor the third capillary overlap with a portion of the first second tube that is in alignment with the second valve.

In one embodiment of the invention, the first discontinuous atmospheric pressure interface is connected to a trapping device and the second discontinuous atmospheric pressure interface connected to the opposite side of the trapping device. In a related embodiment of the device, a proximal end of the first capillary is connected to a trapping device, in which the trapping device is below atmospheric pressure. In another related embodiment of the device, a proximal end of the second capillary is connected to a trapping device, in which the trapping device is below atmospheric pressure. In another related embodiment, a distal end of the first tube receives the ions from an ionizing source, in which the ionizing source is at substantially atmospheric pressure.

In certain embodiments of the device, the first and second tubes are comprised of an inert plastic, for example silicone plastic. In other embodiments, the first, second, and third capillaries are comprised of an inert metal, for example stainless steel. In other embodiments of the device, the first, second, and third capillaries have substantially the same outer diameter. In alternative embodiments, the first, second, and third capillaries have different outer diameters. In another embodiment of the device, the first, second, and third capillaries have substantially the same inner diameter. Alternatively, the first, second, and third capillaries have different inner diameters. In another embodiment of the device, the third capillary has a smaller inner diameter than the inner diameter of the second capillary. In another embodiment of the devices, the first and second valves are selected from the group consisting of a pinch valve, a thin plate shutter valve, and a needle valve.

Another aspect of the invention herein provides a discontinuous atmospheric pressure interface system including: an ionizing source for converting molecules into gas phase ions in a region at about atmospheric pressure; a trapping device; and two discontinuous atmospheric pressure interfaces for transferring the ions from the region at about atmospheric pressure to at least one other region at a reduced pressure, in which each interface includes a valve for controlling entry of the ions into the trapping device such that the ions are transferred into the trapping device in a discontinuous mode.

In a related embodiment, the system further includes at least one vacuum pump connected to the trapping device. In another related embodiment of the system, the first atmospheric pressure interface further includes: a first tube, in which an exterior portion of the first tube is aligned with the first valve; and a first capillary inserted into a first end of the first tube such that the first capillary does not overlap with a portion of the first tube that is in alignment with the valve; and the second atmospheric pressure interface further includes: a second tube, in which an exterior portion of a second valve aligned with an exterior portion of a second tube, and a second capillary inserted into a first end of the second tube and a third capillary inserted into a second end of the second tube, in which neither the second capillary nor the third capillary overlap with a portion of the first second tube that is in alignment with the second valve. In another embodiment of the system, the first atmospheric pressure interface further includes a tube, in which an exterior portion of the tube is aligned with the valve. In another embodiment of the system, the second atmospheric pressure interface further include a tube, in which an exterior portion of the tube is aligned with the valve.

In certain embodiments of the system, ions enter the trapping device when the valves are in an open position. In another embodiment of the system, ions are prevented from entering the trapping device when the valves are in a closed position. The closed position refers to complete closure of the valves, and also includes quasi-closure of the valves, i.e, the valves are substantially closed such that pumping significantly exceeds ingress of gas or vapor. Substantially closed includes at least about 70% closed, at least about 80% closed, at least about 90% closed, at least about 95% closed, or at least about 99% closed.

In another embodiment, the system further includes a computer operably connected to the system. In another embodiment, the computer contains a processor configured to execute a computer readable program, the program controlling the positions of the valves. In another embodiment, the computer contains a processor configured to execute a computer readable program, the program implementing a selected waveform inverse Fourier transformation (SWIFT) isolation algorithm to separate ions.

In certain embodiments of the system, the ionizing source operates by a technique selected from the group consisting of: electrospray ionization, nano-electrospray ionization, atmospheric pressure matrix-assisted laser desorption ionization, atmospheric pressure chemical ionization, desorption electrospray ionization, atmospheric pressure dielectric barrier discharge ionization, atmospheric pressure low temperature plasma desorption ionization, and electrospray-assisted laser desorption ionization. In another embodiment of the system, the trapping device is selected from the group consisting of a mass analyzer of a mass spectrometer, a mass analyzer of a handheld mass spectrometer, and an intermediate stage storage device.

In another embodiment of the system, the mass analyzer is selected from the group consisting of: a quadrupole ion trap, a rectalinear ion trap, a cylindrical ion trap, a ion cyclotron resonance trap, and an orbitrap. In another embodiment of the system, the intermediate storage device is coupled with a mass analyzer of a mass spectrometer or a mass analyzer of a handheld mass spectrometer. In a related embodiment, the mass analyzer is selected from the group consisting of: a mass filter, a quadrupole ion trap, a rectalinear ion trap, a cylindrical ion trap, a ion cyclotron resonance trap, an orbitrap, a time of flight mass spectrometer, and a magnetic sector mass spectrometer. In yet another embodiment, the system further includes an ion accumulating surface connected to a distal end of the first tube. In another embodiment of the system, the tubes of the atmospheric interfaces are comprised of an inert plastic, for example silicone plastic. In another embodiment of the system, the first, second, and third capillary of the atmospheric interface are comprised of an inert metal, for example stainless steel.

In certain embodiments of the system, the valves operate to control entry of ions in a synchronized manner with respect to operation of the mass analyzer. In another embodiment of the system, the configuration of the discontinuous atmospheric pressure interface and the mass analyzer is off-axis. In another embodiment of the system, an ion optical element, for example, a focusing tube lens, is located between first discontinuous atmospheric pressure interface and the mass analyzer to direct the ions into the mass analyzer. In another embodiment, the system further includes an ion optical element located between the ionization source and the first discontinuous atmospheric pressure interface to direct the ions into the mass analyzer.

In another embodiment of the invention, the first discontinuous atmospheric pressure interface is optimized with respect to capillary size, capillary distance from the mass analyzer and optional ion optical element, then the second discontinuous atmospheric pressure interface is implemented on the opposite side of the mass analyzer.

Another aspect of the invention provides a kit including the above devices and a container. Another aspect of the invention provides a kit including the above system and a container. In certain embodiments, the kits include instructions for use.

Another aspect of the invention provides a method of discontinuously transferring ions at atmospheric pressure into a trapping device at reduced pressure, the method including: opening a valve connected to an atmospheric pressure interface, such that opening of the valve allows for transfer of ions substantially at atmospheric pressure to a trapping device at reduced pressure; and closing the valve connected to the atmospheric pressure interface, such that closing the valve prevents additional transfer of the ions substantially at atmospheric pressure to the trapping device at reduced pressure.

In certain embodiments, prior to opening a valve, the method further includes converting molecules to gas phase ions. In other embodiments, the converting step is selected from the group consisting of: electrospray ionization, nanoelectrospray ionization, atmospheric pressure matrix-assisted laser desorption ionization, atmospheric pressure chemical ionization, desorption electrospray ionization, atmospheric pressure dielectric barrier discharge ionization, atmospheric pressure low temperature plasma desorption ionization, and electrospray-assisted laser desorption ionization.

In another embodiment of the method, the opening and the closing of the valves are controlled by a computer operably connected to the atmospheric pressure interface. In another embodiment of the method, the trapping device is selected from the group consisting of a mass analyzer of a mass spectrometer, a mass analyzer of a handheld mass spectrometer, and an intermediate stage storage device. In another embodiment of the method, the mass analyzer is selected from the group consisting of: a quadrupole ion trap, a rectalinear ion trap, a cylindrical ion trap, a ion cyclotron resonance trap, and an orbitrap. In another embodiment of the method, the intermediate storage device is coupled with a mass analyzer of a mass spectrometer or a mass analyzer of a handheld mass spectrometer. In a related embodiment, the mass analyzer is selected from the group consisting of: a mass filter, a quadrupole ion trap, a rectalinear ion trap, a cylindrical ion trap, a ion cyclotron resonance trap, an orbitrap, a time of flight mass spectrometer, and a magnetic sector mass spectrometer.

In certain embodiments of the method, electrical voltage of the mass analyzer is set to ground when a valve is open. In other embodiments of the method, subsequent to the ions being transferred into the mass analyzer and a valve being closed, the ions are retained by the mass analyzer for further manipulation. In another embodiment of the method, prior to further manipulation, the ions are cooled and the pressure is further reduced. In yet another embodiment of the method, further manipulation includes mass analysis of the ions.

In certain embodiments of the method, the computer synchronizes the opening and the closing of the valves with a sequence of mass analysis of the ions in the mass analyzer. In a related embodiment of the method, the computer synchronizes the opening and the closing of the valves with a sequence of steps that allow tandem mass analysis of the ions in the mass analyzer.

In another embodiment of the method, the first atmospheric pressure interface further includes: a first tube, in which an exterior portion of the first tube is aligned with the first valve; and a first capillary inserted into a first end of the first tube such that the first capillary does not overlap with a portion of the first tube that is in alignment with the valve; and the second atmospheric pressure interface further includes: a second tube, in which an exterior portion of a second valve aligned with an exterior portion of a second tube, and a second capillary inserted into a first end of the second tube and a third capillary inserted into a second end of the second tube, in which neither the second capillary nor the third capillary overlap with a portion of the first second tube that is in alignment with the second valve. In related embodiments of the method, the valves are selected from the group consisting of a pinch valve, a thin shutter plate valve, and a needle valve.

In another embodiment of the method, after converting the molecules to ions, the ions are stored on a functional surface connected to the distal end of the first tube at atmospheric pressure, in which the functional surface is continuously supplied with ions from a continuously operated ion source. In related embodiments, the ions stored on the functional surface are subsequently transferred by the atmospheric pressure interface to the trapping device.

In another embodiment of the method, the first, second, and third capillaries of the atmospheric interfaces have substantially the same outer diameter. Alternatively, the first, second, and third capillaries of the atmospheric interfaces have different outer diameters. In another embodiment of the method, first, second, and third capillaries of the atmospheric interfaces have substantially the same inner diameter. Alternatively, the first, second, and third capillaries of the atmospheric interfaces have different inner diameters. In another embodiment of the method, the third capillary has a smaller inner diameter that the inner diameter of the secondary capillary.

Another aspect of the invention provides a method of discontinuously transferring ions into a mass spectrometer, the method including: opening a valve connected to an atmospheric pressure interface, such that opening of the valve allows for transfer of ions substantially at atmospheric pressure to a mass analyzer at a reduced pressure in the mass spectrometer; and closing the valve connected to the atmospheric pressure interface, such that closing the valve prevents additional transfer of the ions substantially at atmospheric pressure to the mass analyzer at the reduced pressure in the mass spectrometer.

In another embodiment of the method, the second valve is open during the ionization period together with the first valve. In a further embodiment of the method, the second valve is open after the ionization period.

In another embodiment of the method, the first and second valves can be opened or closed at various times during ionization and ion cooling in order to introduce gas flow into the trapping device. In a related embodiment of the invention, this gas flow can induce collisional dissociation for some compounds. In a related embodiment, these compounds are small organic compounds.

In another aspect of the invention, ions and/or molecules can react in a device with two discontinuous atmospheric pressure interfaces. In a related embodiment, an ion can be introduced into the trapping device by opening valve 1 and reactive ions or molecules can subsequently be introduced into the trapping device by opening valve 2.

In yet another embodiment of the device, a fourth capillary is connected to the distal end of the first tube. In a related embodiment of the method, after converting the molecules to ions, the ions are stored on a functional surface connected to the distal end of the fourth capillary connected first tube at atmospheric pressure, in which the functional surface is continuously supplied with ions from a continuously operated ion source.

In another embodiment of the device, more than two discontinuous atmospheric pressure interfaces can be connected to the trapping device. In a related embodiment, such discontinuous atmospheric pressure interfaces would have the same properties as described above.

In an other embodiment of the method, ions and/or molecules can react in a device with more than two discontinuous atmospheric pressure interfaces. In a related embodiment, an ion can be introduced into the trapping device by opening one valve and reactive ions or molecules can subsequently be introduced into the trapping device by opening at least one of the other valves.

In yet another embodiment of the device, the discontinuous atmospheric pressure interface is comprised of a valve aligned with an exterior portion of a tube, in which the valve controls the movement of ions through the tube. In a related embodiment, the tube is connected to a trapping device. These embodiments may have the same properties as described above.

BRIEF DESCRIPTION OF THE DRAWINGS

FIG. 16A is a pumping systems test comparing: a 30 $m^3$/h roughing pump together with a 345 l/s turbo pump; a 307 $m^3$/h roughing pump together with a 345 l/s turbo pump and a 307 $m^3$/h roughing pump together with two turbo pumps, 345 l/s and 210 l/s.

FIG. 16B is a gas dynamic simulation of the gas flow for the DAPI-RIT interface from 760 torr to 10 torr.

FIG. 16C is a gas dynamic simulation of the gas flow for the DAPI-RIT interface from 760 torr to 0.4 torr.

FIG. 18A is horizontal time graph of a scan function wherein the second pinch valve is also opened during the cooling period.

FIGS. 18B-D depict the effects of gas blow effects on the mass spectra of WAGGDApSGE. 18B is with no gas bLow, 18C is with 45 ms gas blow, and 18D is with 75 ms gas blow.

FIG. 20A is horizontal time graph of a scan function for gas flow assisted collisional induced dissociation.

FIGS. 20B-D depict tandem mass spectra for 5 ng/uL of cocaine with respect to different gas flow durations. 20B is with 16 ms gas flow, 20C is with 56 ms gas flow, and 20D is with 25 ms+25 ms gas flow.

FIG. 21A is horizontal time graph of a scan function for ion-molecule and ion-ion reactions.

FIG. 21B depicts the mass spectra of the proton transfer between angiotensin 1 cation and azobenzene molecule.

FIG. 21C is a detail of a portion of the spectrum of FIG. 21B.

FIG. 22A shows a single MS scan for 54.4 attomole bradykinin (10 ng/uL). FIG. 22B shows a tandom MS scan of 136 attomole bradykinin (10 ng/uL).

DETAILED DESCRIPTION OF THE INVENTION

Figure 1:
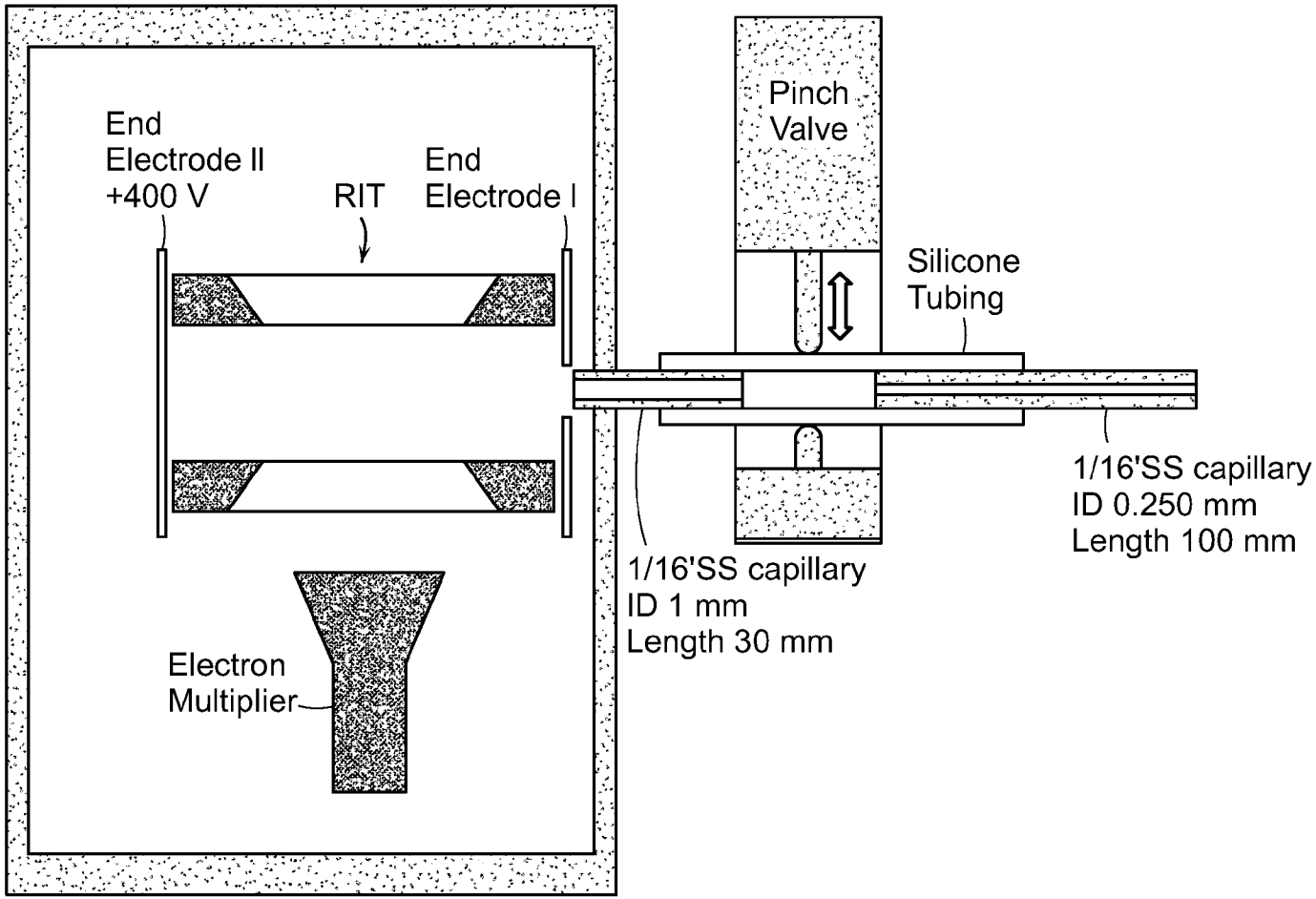
FIG. 1 is a schematic view of a discontinuous atmospheric pressure interface coupled in a miniature mass spectrometer with rectilinear ion trap.

For ion trap type mass spectrometers, the pumping capability is not efficiently used with a traditional constantly open API. The ions are usually allowed to pass into the ion trap for only part of each scan cycle but neutrals are constantly leaked into the vacuum manifold and need to be pumped away to keep the pressure at the low levels typically needed for mass analysis.

Although the mass analysis using an ion trap usually requires an optimal pressure at several milli-torr or less, ions can be trapped at a much higher pressure. (Shaffer, S. A.; Tang, K. Q.; Anderson, G. A.; Prior, D. C.; Udseth, H. R.; Smith, R. D. *Rapid Communications in Mass Spectrometry* 1997, 11, 1813-1817) Taking advantage of this characteristic of an ion trap, an alternative atmospheric pressure interface, discontinuous atmospheric pressure interface (DAPI), is proposed here to allow maximum ion transfer at a given pumping capacity for mass spectrometers containing an ion trapping component. The concept of the discontinuous API is to open its channel during ion introduction and then close it for subsequent mass analysis during each scan. An ion transfer channel with a much bigger flow conductance can be allowed for a discontinuous API than for a traditional continuous API. The pressure inside the manifold temporarily increases significantly when the channel is opened for maximum ion introduction.

All high voltages can be shut off and only low voltage RF is on for trapping of the ions during this period. After the ion introduction, the channel is closed and the pressure can decrease over a period of time to reach the optimal pressure for further ion manipulation or mass analysis when the high voltages can be is turned on and the RF can be scanned to high voltage for mass analysis.

A discontinuous API opens and shuts down the airflow in a controlled fashion. The pressure inside the vacuum manifold increases when the API opens and decreases when it closes. The combination of a discontinuous atmospheric pressure interface with a trapping device, which can be a mass analyzer or an intermediate stage storage device, allows maximum introduction of an ion package into a system with a given pumping capacity.

Much larger openings can be used for the pressure constraining components in the API in the new discontinuous introduction mode. During the short period when the API is opened, the ion trapping device is operated in the trapping mode with a low RF voltage to store the incoming ions; at the same time the high voltages on other components, such as conversion dynode or electron multiplier, are shut off to avoid damage to those device and electronics at the higher pressures. The API can then be closed to allow the pressure inside the manifold to drop back to the optimum value for mass analysis, at which time the ions are mass analyzed in the trap or transferred to another mass analyzer within the vacuum system for mass analysis. This two-pressure mode of operation enabled by operation of the API in a discontinuous fashion maximizes ion introduction as well as optimizing conditions for the mass analysis with a given pumping capacity.

The design goal is to have largest opening while keeping the optimum vacuum pressure for the mass analyzer, which is between $10^{-3}$ to $10^{-10}$ torr depending the type of mass analyzer. The larger the opening in an atmospheric pressure interface, the higher is the ion current delivered into the vacuum system and hence to the mass analyzer.

A device of simple configuration was designed to test the concept of the discontinuous API with a Mini 10 handheld mass spectrometer. A Mini 10 handheld mass spectrometer is shown in Gao, L.; Song, Q.; Patterson, G. E.; Cooks, R. G.; Ouyang, Z. *Anal. Chem.* 2006, 78, 5994-6002. In comparison with the pumping system used for lab-scale instruments with thousands watts of power, the Mini 10 has a 18 W pumping system with only a 5 L/min (0.3 $m^3$/hr) diaphragm pump and a 11 L/s turbo pump. The discontinuous API was designed to connect the atmospheric pressure region directly to the vacuum manifold without any intermediate vacuum stages. Due to the leakage of a relatively large amount of air into the manifold during ion introduction, traps with relatively good performance with air as buffer gas are preferred as the mass analyzer for the discontinuous API. A rectilinear ion trap was used in Mini 10 for mass analysis, for which the performance with air buffer gas had been demonstrated previously. (Gao, L.; Song, Q.; Patterson, G. E.; Cooks, R. G.; Ouyang, Z. *Anal. Chem.* 2006, 78, 5994-6002) Various atmospheric pressure ionization methods, including ESI, APCI and DESI, were coupled to the Mini 10 and limit of detection (LOD) comparable with lab-scale instruments was achieved while unit resolution and tandem mass spectrometry efficiency were also retained.

A first embodiment is shown in FIG. 1, in which a pinch valve is used to open and shut off the pathway in a silicone tube connecting the regions at atmospheric pressure and in vacuum. A normally-closed pinch valve (390NC24330, ASCO Valve Inc., Florham Park, N.J.) was used to control the opening of the vacuum manifold to atmospheric pressure region. Two stainless steel capillaries were connected to the piece of silicone plastic tubing, the open/closed status of which is controlled by the pinch valve. The stainless steel capillary connecting to the atmosphere is the flow restricting element, and has an ID of 250 μm, an OD of 1.6 mm (1/16") and a length of 10 cm. The stainless steel capillary on the vacuum side has an ID of 1.0 mm, an OD of 1.6 mm (1/16") and a length of 5.0 cm. The plastic tubing has an ID of 1/16", an OD of 1/8" and a length of 5.0 cm. Both stainless steel capillaries are grounded. The pumping system of the mini 10 consists of a two-stage diaphragm pump 1091-N84.0-8.99 (KNF Neuberger Inc., Trenton, N.J.) with pumping speed of 5 L/min (0.3 $m^3$/hr) and a TPD011 hybrid turbomolecular pump (Pfeiffer Vacuum Inc., Nashua, N.H.) with a pumping speed of 11 L/s.

When the pinch valve is constantly energized and the plastic tubing is constantly open, the flow conductance is so high that the pressure in vacuum manifold is above 30 torr with the diaphragm pump operating. The ion transfer efficiency was measured to be 0.2%, which is comparable to a lab-scale mass spectrometer with a continuous API. However, under these conditions the TPD 011 turbomolecular pump can not be turned on. When the pinch valve was de-energized, the plastic tubing was squeezed closed and the turbo pump could then be turned on to pump the manifold to its ultimate pressure in the range of $1\times10^{-5}$ torr.

Figure 2A:
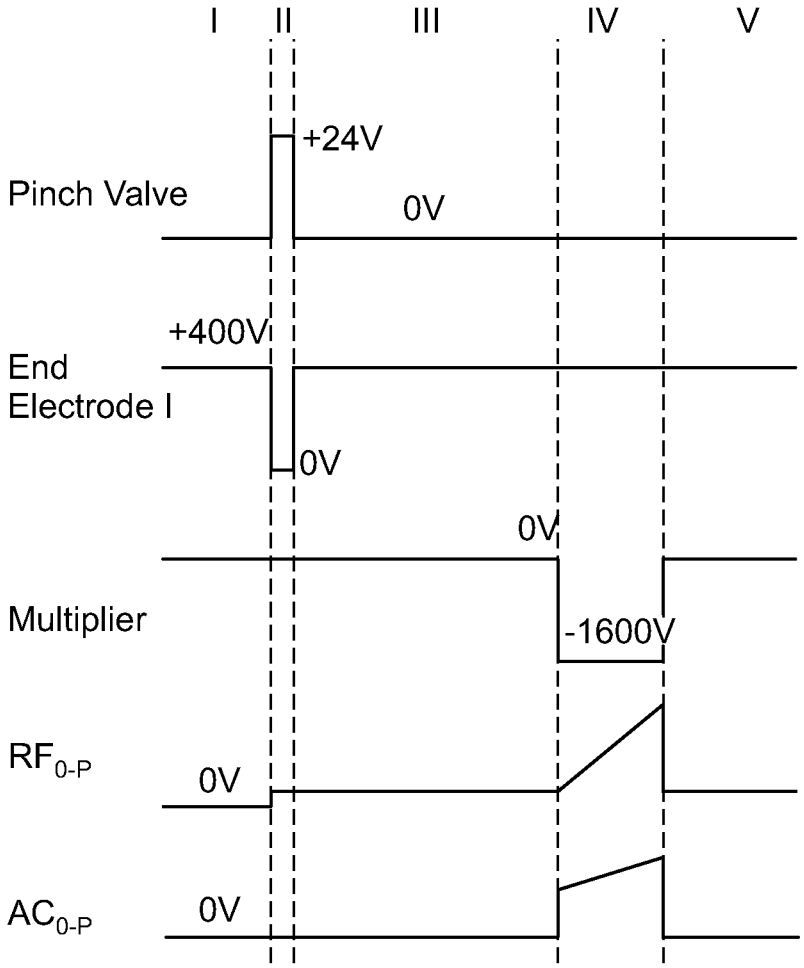
FIG. 2A is a horizontal time graph of a typical scan function used for mass analysis using a discontinuous atmospheric pressure interface.

The sequence of operations for performing mass analysis using ion traps usually includes, but is not limited to, ion introduction, ion cooling and RF scanning. After the manifold pressure is pumped down initially, a scan function shown in FIG. 2A was implemented to switch between open and close modes for ion introduction and mass analysis. During the ionization time, a 24 V DC was used to energize the pinch valve and the API was open. The potential on the RIT end electrode I was also set to ground during this period. A minimum response time for the pinch valve was found to be 10 ms and an ionization time between 15 ms and 30 ms was used for the characterization of the discontinuous API. A cooling time between 250 ms to 500 ms was implemented after the API was closed to allow the pressure to decrease and the ions to cool down via collisions with background air molecules. The high voltage on the electron multiplier was then turned on and the RF voltage was scanned for mass analysis.

Figure 2B:
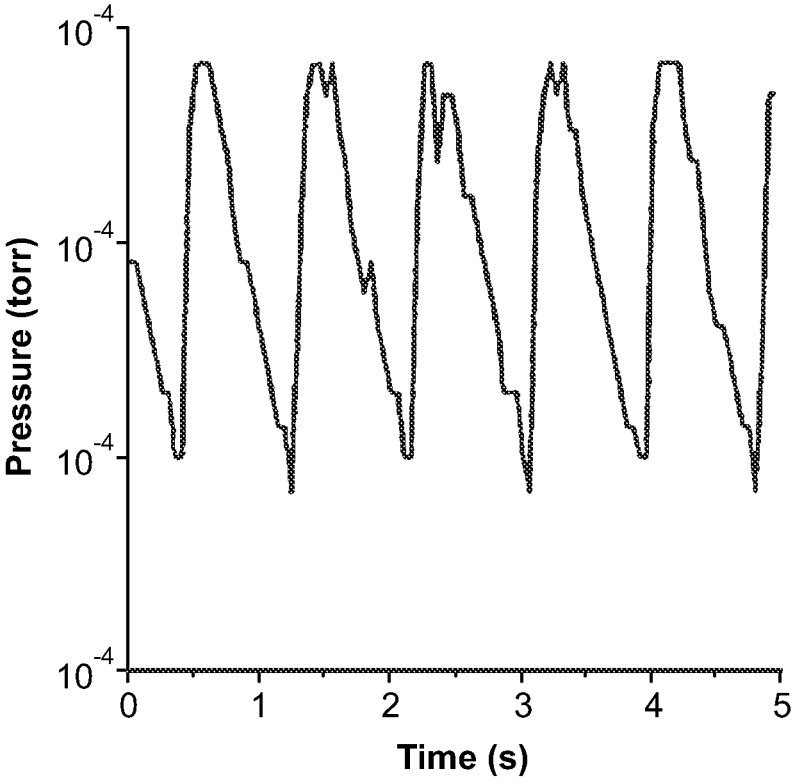
FIG. 2B is a horizontal time graph of a manifold pressure measured during scanning, with an open time of 20 ms and a close time of 800 ms for the DAPI.

During the operation of the discontinuous API, the pressure change in the manifold can be monitored using the micro pirani vacuum gauge (MKS 925C, MKS Instruments, Inc. Wilmington, Mass.) on Mini 10. With an open time of 20 ms and a close time of 850 ms, the reading of the pirani gauge was recorded and is plotted as shown in FIG. 2B. A pressure variation between $8\times10^{-2}$ torr to $1\times10^{-3}$ torr was measured. Capillaries with different flow conductance were tested as the flow restricting element, including 10 cm capillaries with a 127 μm ID and 500 μm ID. It was found that the sensitivity significantly decreased with the former and a much longer cooling time, 2 to 3 s, was required for pressure to drop with the latter.

Different atmospheric ionization sources were used with the mini 10 mass spectrometer to verify the performance of this discontinuous atmospheric pressure interface. A scan speed of 5000 m/z per second was used for mass analysis with a resonance ejection AC of 350 kHz and an electron multiplier voltage of −1600V was used for ion detection. Sample solutions used for ESI and nano ESI were prepared using 1:1 methanol water with 0.5% acetic acid. A 250 ppm standard acetonitrile drug mixture solution (Alltech-Applied Science Labs, State College, Pa.) of methamphetamine, cocaine and heroin was diluted for preparation of samples at various concentrations.

Figure 3B:
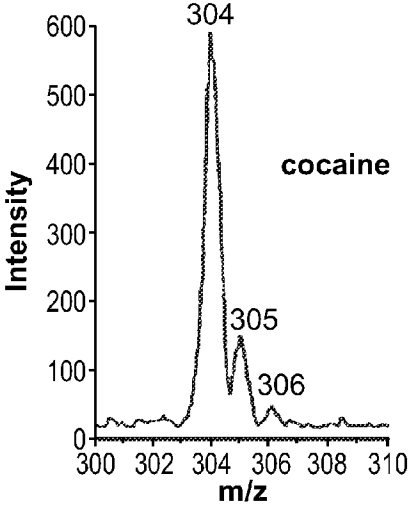
FIG. 3B is a detail of a portion of the spectrum of FIG. 3A.
Figure 3A:
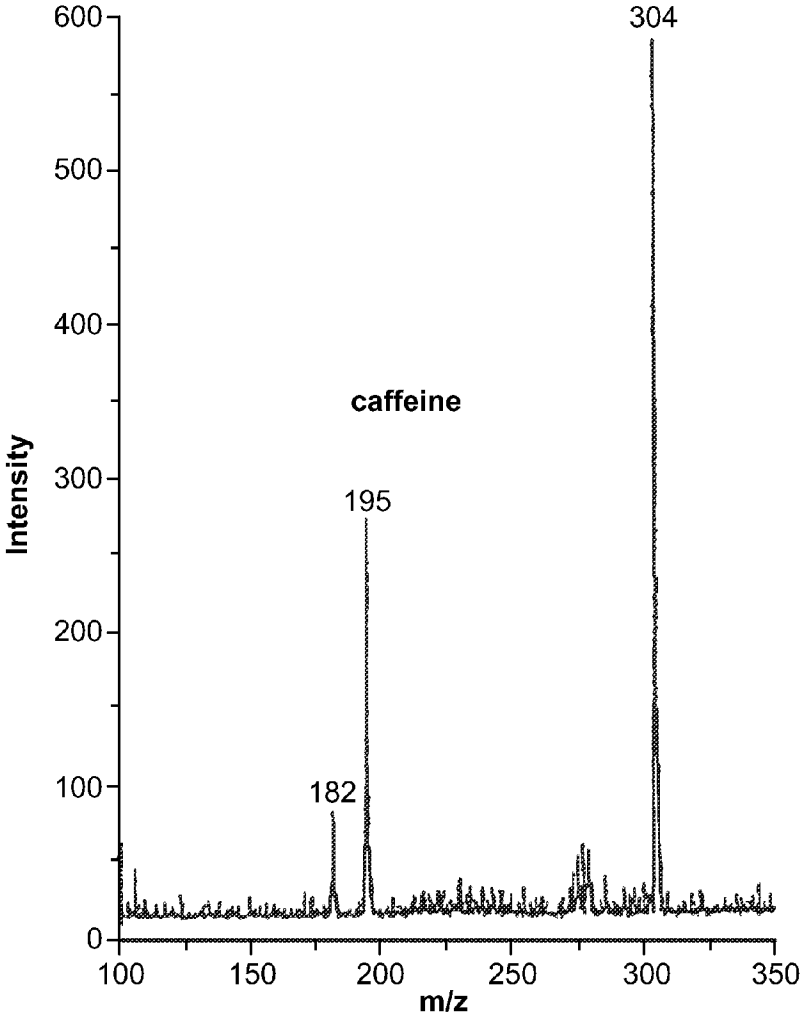
FIG. 3A is a nano ESI mass spectrum recorded using a DAPI for a 5 ppm solution of caffeine and cocaine, 20 ms ion introduction time and 500 ms cooling time.
Figure 4A:
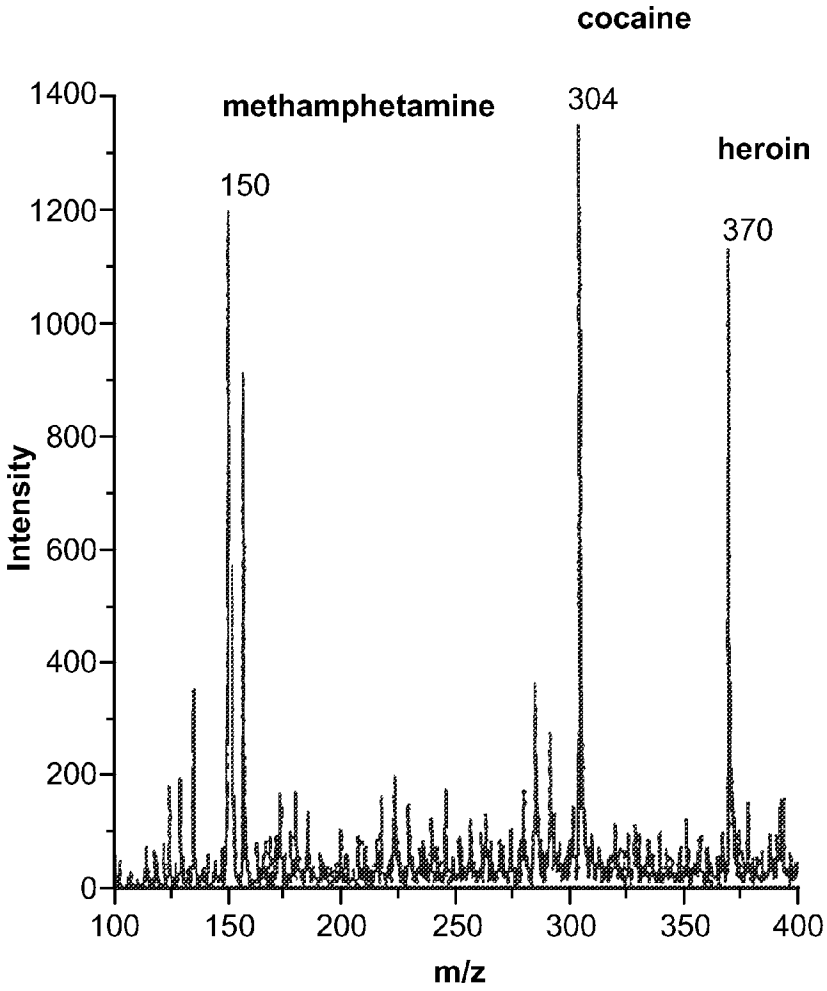
FIG. 4A is a nano ESI mass spectrum of a 500 ppb mixture solution of methylamphetamine, cocaine and heroin.
Figure 3C:
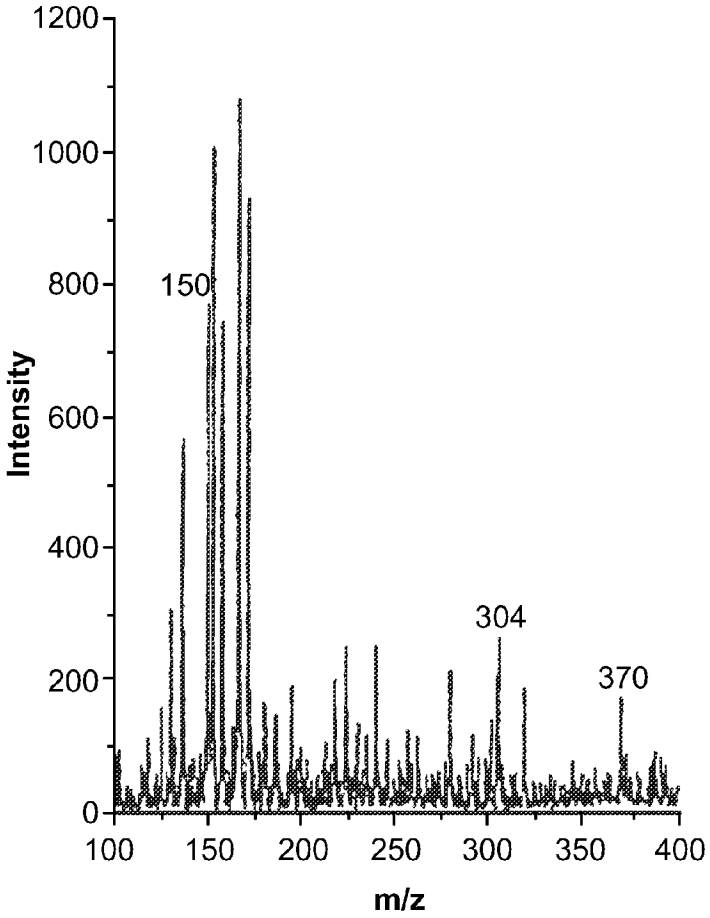
FIG. 3C is a nano ESI mass spectrum recorded using a DAPI for a 50 ppb mixture solution of methylamphetamine, cocaine and heroin, 25 ms ion introduction time and 500 ms cooling time.
Figure 4C:
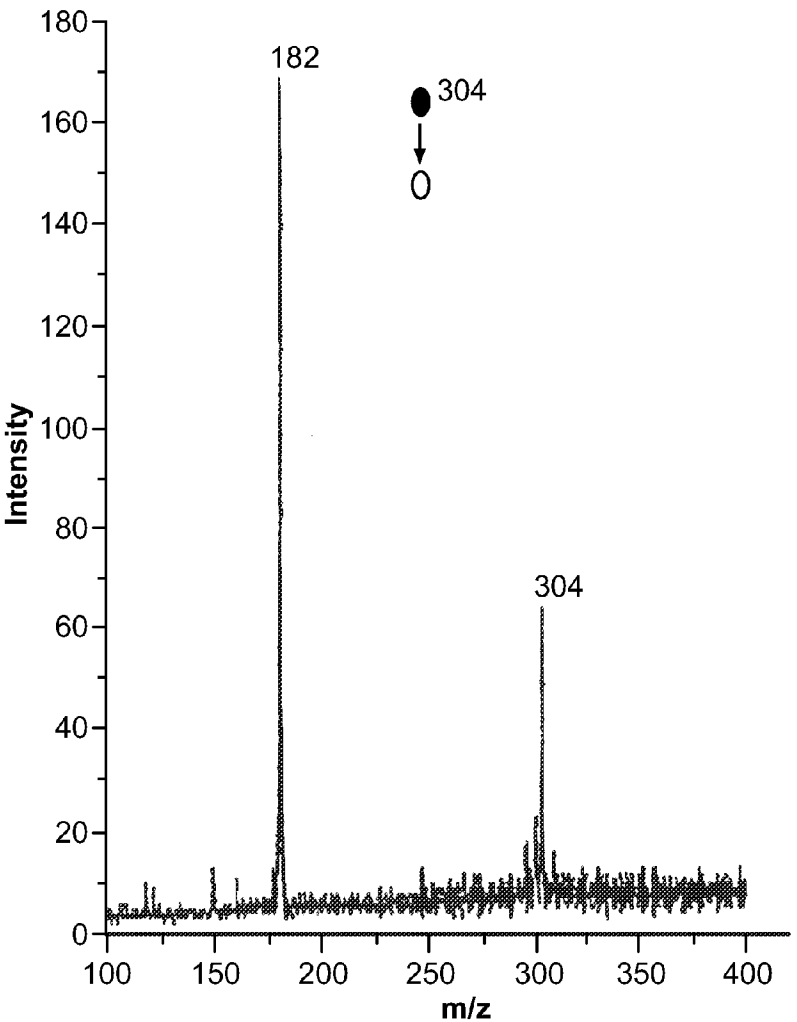
FIG. 4C is a MS/MS mass spectra of molecular ion of cocaine m/z 304, SWIFT notchth 300 to 310 kHz and excitation AC at 100 kHz.
Figure 4B:
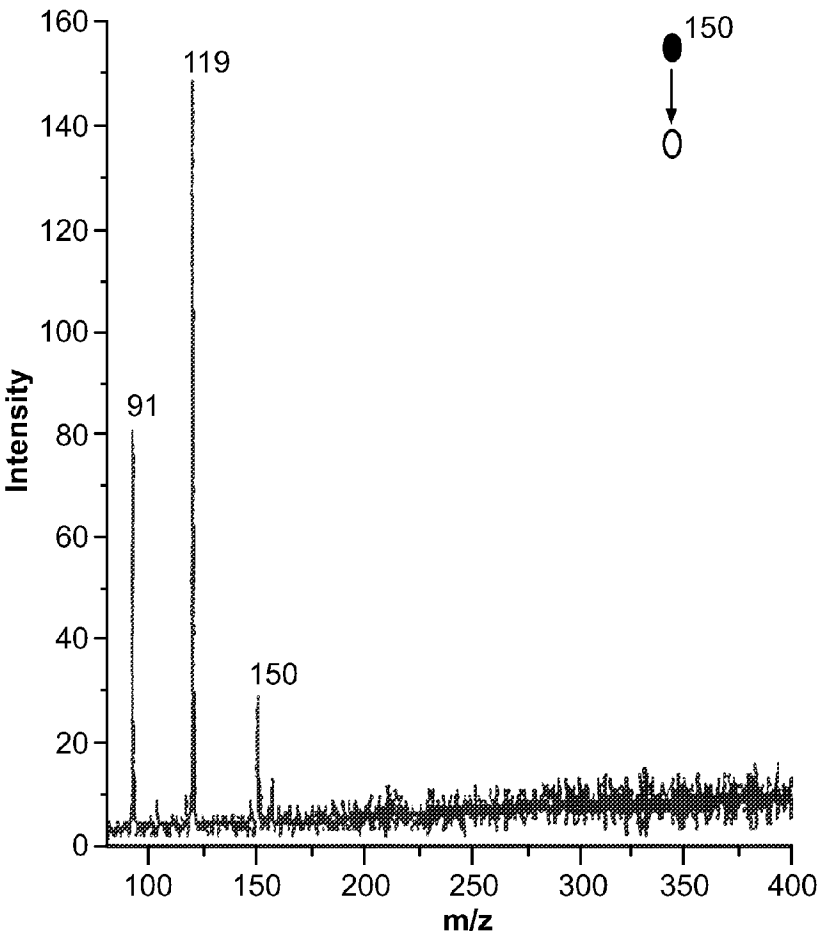
FIG. 4B is a MS/MS mass spectra of molecular ions of methylamphetamine m/z 150, SWIFT notch 300 to 310 kHz and excitation AC at 100 kHz.
Figure 4D:
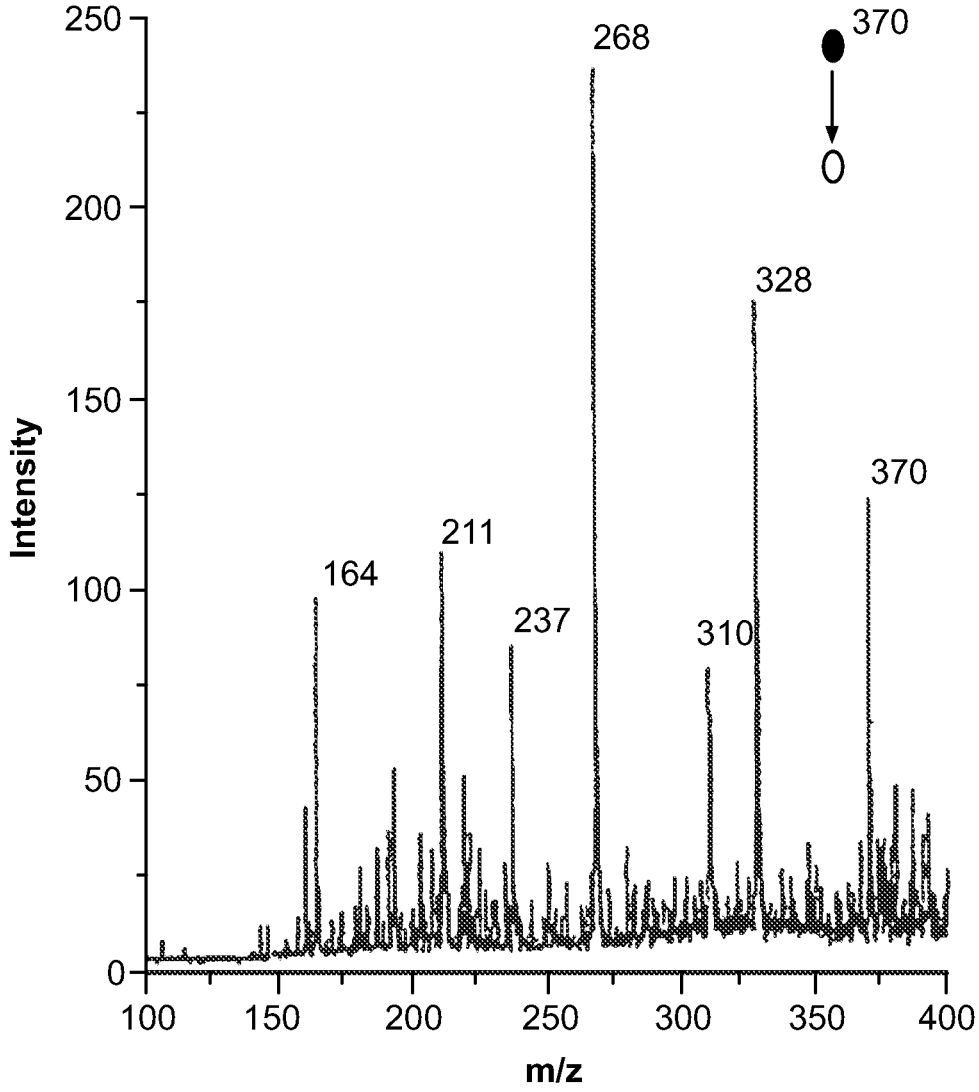
FIG. 4D is a MS/MS mass spectra of molecular ion of heroin m/z 370, SWIFT notch 300 to 310 kHz and excitation AC at 100 kHz.
Figure 8:
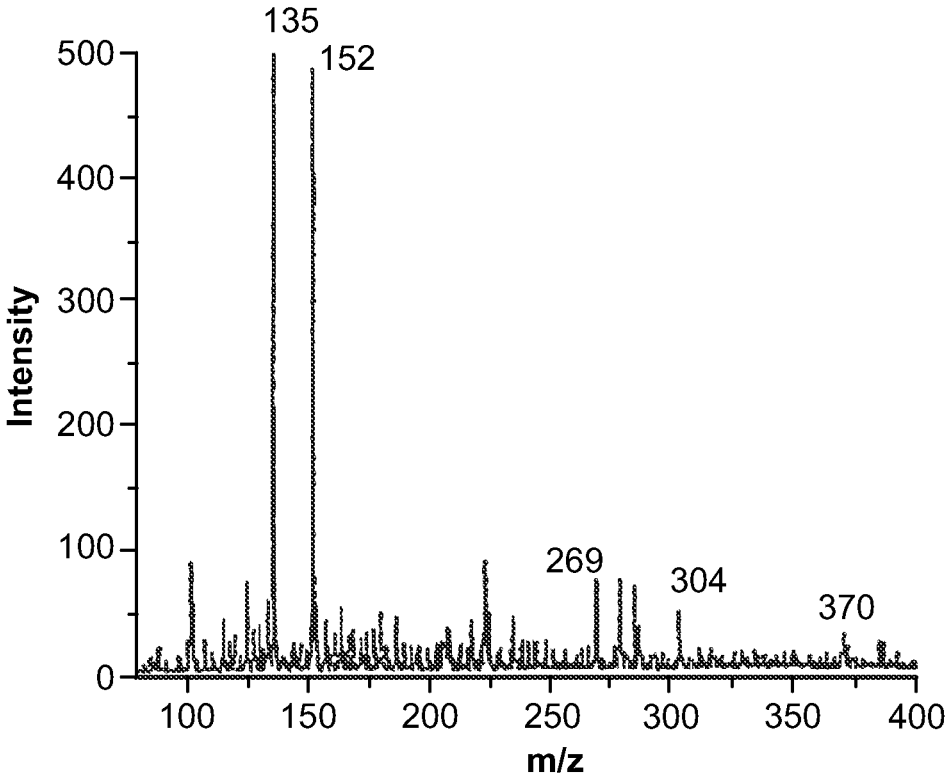
FIG. 8 is a nano ESI mass spectrum of a 400 ppt mixture solution of methamphetamine, cocaine and heroin.

The discontinuous API on the Mini 10 was first characterized with a nano ESI source, which was set up using a nano spray tip prepared in house. (Wilm, M.; Mann, M. *Anal. Chem.* 1996, 68, 1-8; Pan, P.; Gunawardena, H. P.; Xia, Y.; Mckuckey, S. A. *Anal. Chem.* 2004, 76, 1165-1174) A spray voltage between 1.3 and 2.5 kV was applied. A sample solution containing 5 ppm caffeine and cocaine were analyzed using the Mini 10 with the discontinuous API. The RF voltage was set at a low mass cut-off (LMCO) of m/z 60 corresponding to about 160 $V_{0\text{-}p}$, during the 20 ms ion introduction of the DAPI and was scanned to m/z 450 (1200 $V_{0\text{-}p}$) to record a spectrum as shown in FIGS. 3A and 3B. The protonated molecules m/z 195 from caffeine and m/z 304 from cocaine were observed. Though the ion introduction was at much higher pressure, the mass analysis was performed at about 5 milli-torr and unit resolution was obtained. Another sample solution containing 50 ppb methamphetamine, heroine and cocaine was also analyzed with a 20 ms ion introduction time (FIG. 3C). The signal-to-noise ratio is lower for this sample due to the much lower concentration used but a LOD lower than 50 ppb was indicated to be achievable for this sample. Another sample solution containing 400 ppt methamphetamine, cocaine and heroin was also analyzed (FIG. 8), indicating the limit of detection is lower than 400 ppt.

Tandem mass spectrometry can also be performed with a discontinuous API using an altered scan function with two additional periods for ion isolation and ion excitation between the cooling and the RF scan. The ions was first isolated by applying a SWIFT waveform and subsequently fragmented via collision induced dissociation (CID) by applying an excitation AC. (Gao, L.; Song, Q.; Patterson, G. E.; Cooks, R. G.; Ouyang, Z. *Anal. Chem.* 2006, 78, 5994-6002) After 20 ms ion introduction and a 500 ms cooling period, the pressure inside the manifold is in the milli-ton range, a condition for CID that is identical to what was previously used without an atmospheric pressure interface. (Gao, L.; Song, Q.; Patterson, G. E.; Cooks, R. G.; Ouyang, Z. *Anal. Chem.* 2006, 78, 5994-6002) No additional collision gas was added and the air left in the manifold was used as the collision gas. A sample solution containing 500 ppb methamphetamine, cocaine and heroin was analyzed using MS/MS with nano ESI source and discontinuous API. A waveform with a notch window between 300 to 310 kHz was used for the isolation of the precursor ions and an excitation AC at 100 kHz was used for CID. The MS spectrum for the mixture and the $MS^2$ spectra for each of the component were recoded and shown in FIG. 4. Typical fragment patterns were observed for the protononated molecular ions of these three compounds.

For tandem mass analysis, additional operations including ion isolation, ion excitation and ion cooling are added between the ion introduction and final RF scanning steps. The operation of the pinch valve is synchronized with the operation of the ion optics and the RIT scan. The pinch valve is open for around 20 ms in this particular case, during which time ions are allowed to enter the vacuum manifold by setting the voltage on end electrode I of the RIT to ground to allow the ions to enter RIT; during this time the pressure inside the manifold increases. After the pinch valve is shut off, the ions are trapped in the RIT for hundreds of milliseconds and the pressure inside the manifold graduate decreases to optimum values for mass analysis. The high voltages for ion detectors are then turned on, the RF applied on RIT is scanned to mass selectively eject ions and the auxiliary AC for resonance ejection can also be applied at the same time. This sequence of mass analysis steps can be repeated.

Figure 5B:
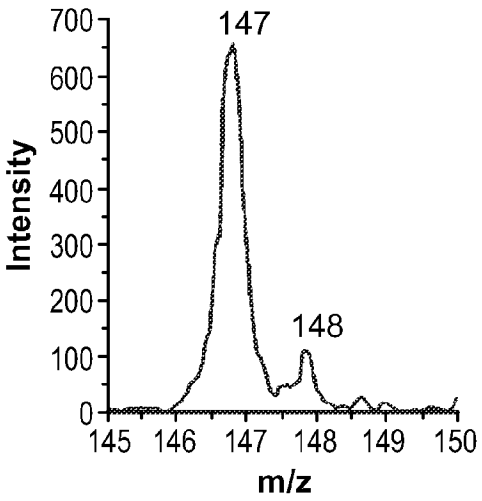
FIG. 5B is a detail of a portion of the spectrum of FIG. 5A.
Figure 5A:
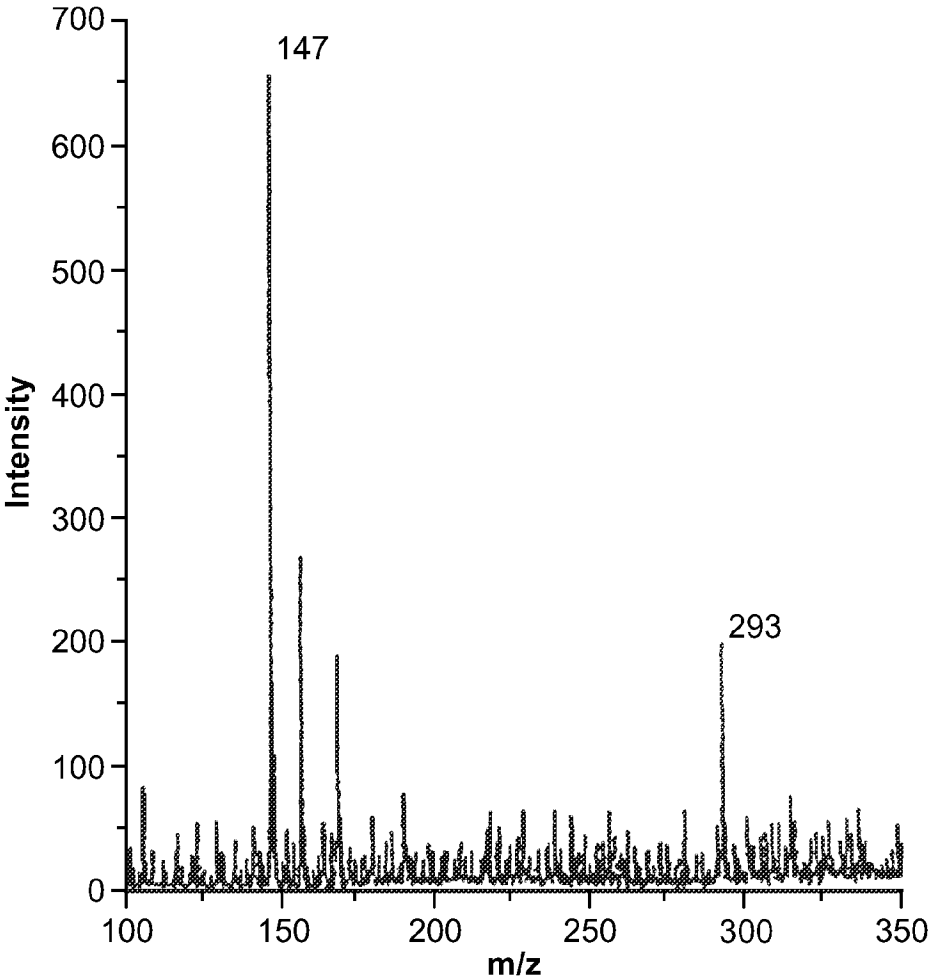
FIG. 5A is a ESI mass spectrum with 20 ms ion introduction of a 500 ppb lysine solution.

The analysis of amino acids was performed with an ESI source using the discontinuous API and Mini 10. The spray direction was angled at 30° with respect to the stainless steel tubing of the interface to minimize the introduction of the neutral droplets into the vacuum system. The sample was sprayed at a flow rate of 0.5 μl/min with a high voltage of 3 kV applied and a sheath gas pressure was 80 psi. An ESI-MS spectrum was recorded with 20 ms ion introduction for a solution containing 500 ppb lysine, as shown in FIGS. 5A and 5B. The protonated molecule $[M+H]^+$(m/z 147) and protonated dimer $[2M+H]^+$(m/z 293) were observed.

Figure 9A:
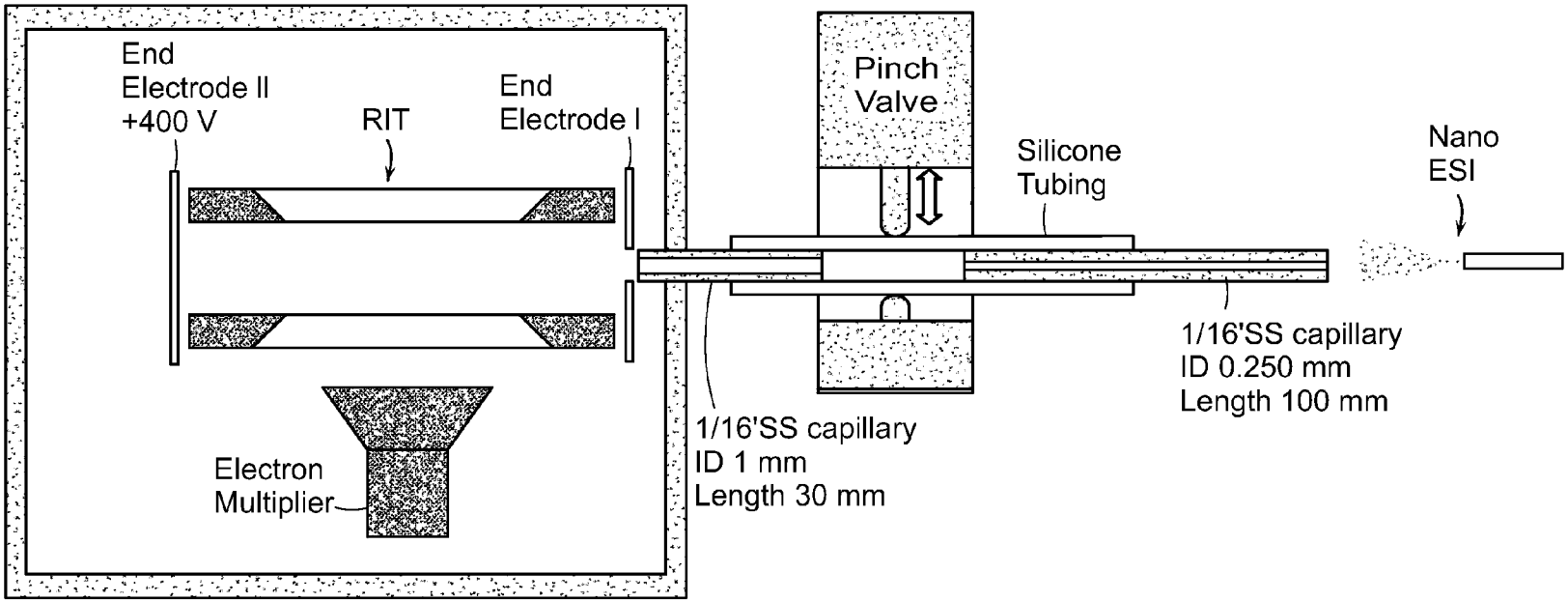
FIG. 9A is a schematic elevation view of a discontinuous atmospheric pressure interface coupled with a miniature mass spectrometer and nano electrospray ionization source.
Figure 9B:
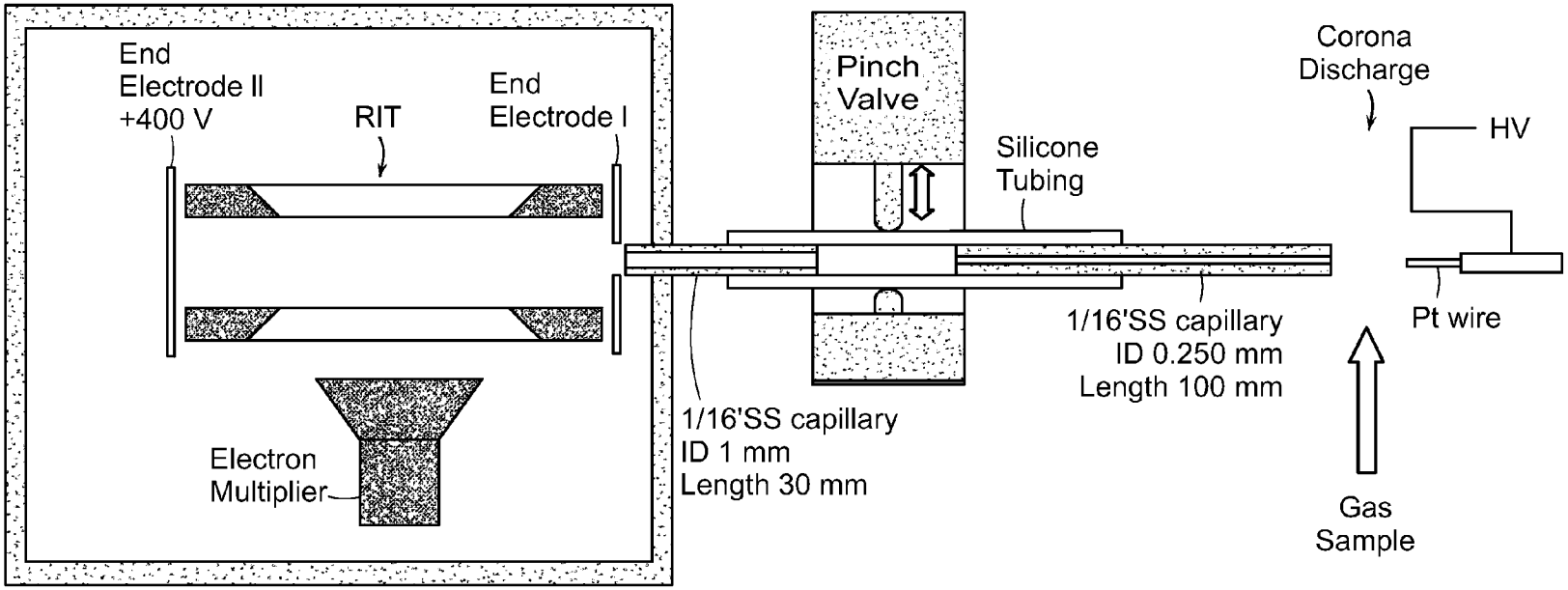
FIG. 9B is a schematic elevation view of a discontinuous atmospheric pressure interface coupled with a miniature mass spectrometer and atmospheric pressure chemical ionization using corona discharge.
Figure 10:
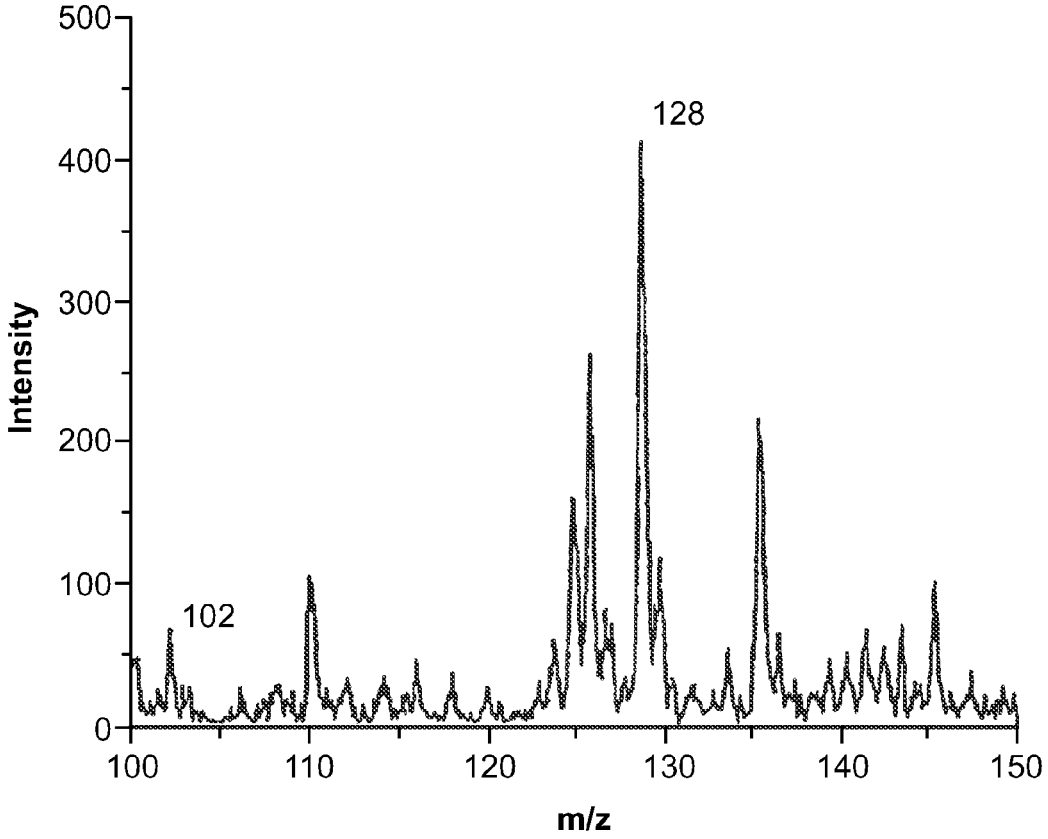
FIG. 10 is an APCI mass spectrum of naphthalene vapor.
Figure 11:
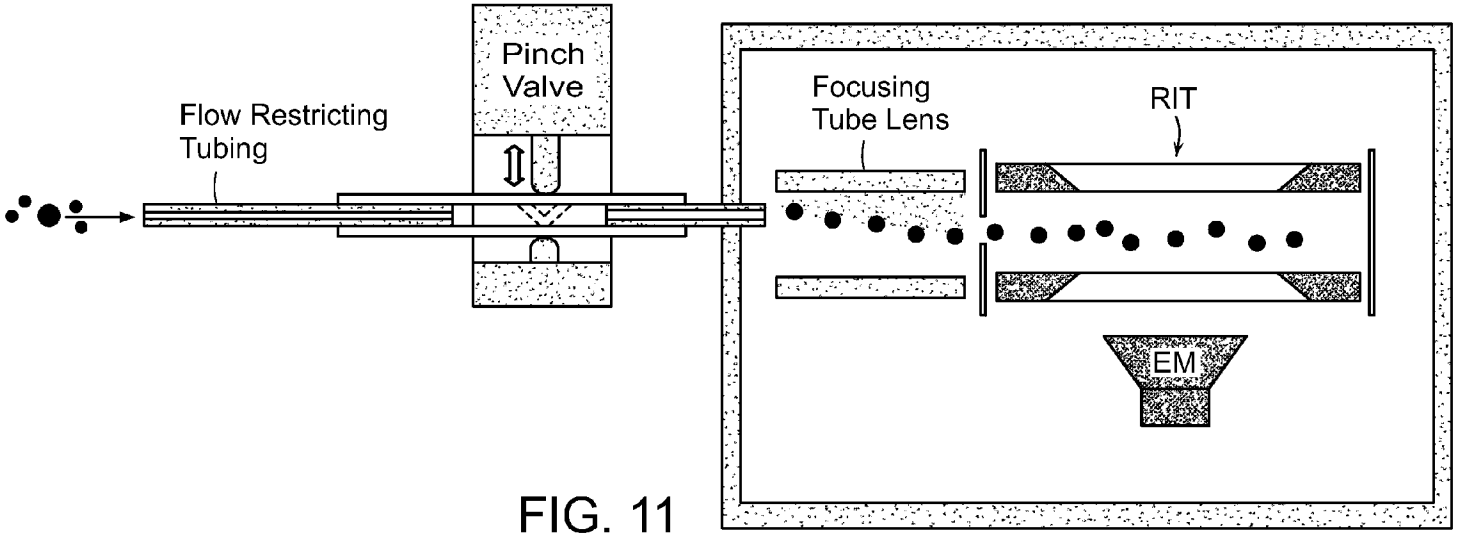
FIG. 11 a schematic elevation view of an off-axis configuration for the combination of discontinuous API and RIT, which avoids direct gas jet into RIT. A focusing tube lens is used to direct the ion beam into the RIT.
Figure 12:
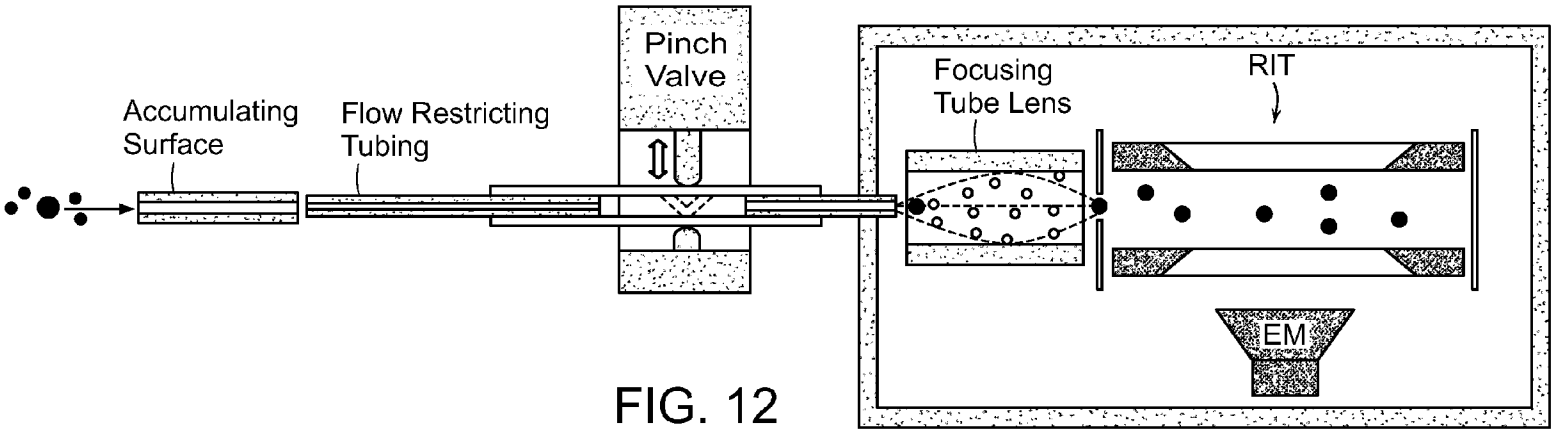
FIG. 12 is a schematic elevation view of a discontinuous atmospheric pressure interface coupled via a tubing with an functional inner surface for ion accumulation and release. The Ions are accumulated for a given time on this inner surface before they are sent through the discontinuous atmospheric pressure interface into the mass analyzer.

In addition to ESI (FIG. 9A), this experiment setup can also be used with other ionization methods. An atmospheric pressure chemical ionization source using a platinum wire for corona discharge was used with the discontinuous atmospheric pressure interface, as shown in FIG. 9B. The vapor from a moth ball was the sample and a spectrum of naphthalene and other chemicals was recorded as shown in FIG. 10.

Figure 5C:
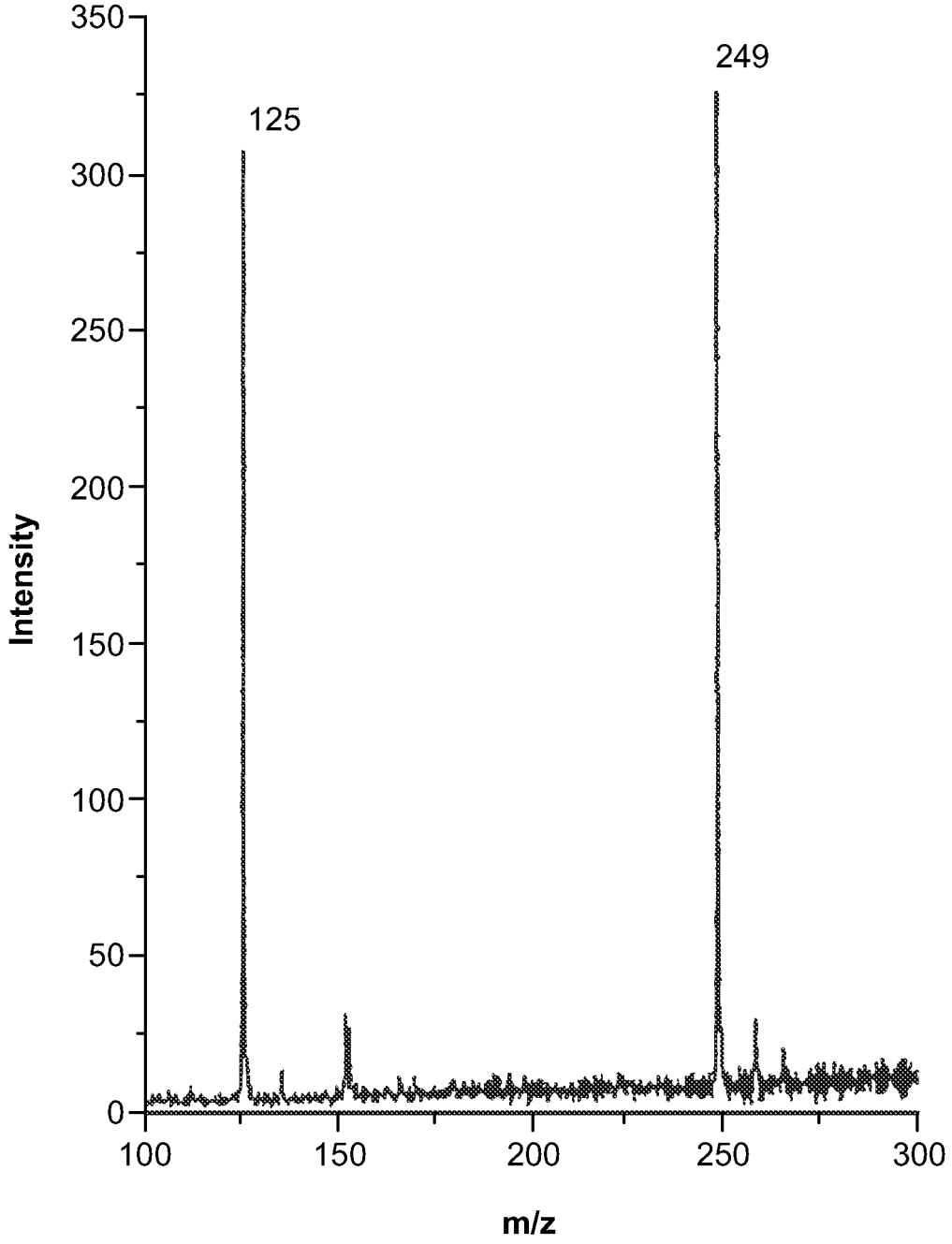
FIG. 5C is a APCI mass spectrum with 20 ms ion introduction of a 50 ppb DMMP in air.

Gas sample analysis with the discontinuous API was demonstrated using the chemical warfare simulant dimethyl methylphosphonate (DMMP) and an APCI source, which was set up for use with the Mini 10 using a stainless steel corona discharge pin as previously described. (Carroll, D. I.; Dzidic, I.; Stillwell, R. N.; Haegele, K. D.; Horning, E. C. *Anal. Chem.* 1975, 47, 2369-2373; Laughlin, B. C.; Mulligan, C. C.; Cooks, R. G. *Anal. Chem.* 2005, 77, 2928-2939) The discharge pin was placed about 5 mm away from the stainless steel capillary inlet with 3 kV voltage applied on it. A 10 ml flask containing 50 ppb DMMP in air was place under the discharge pin and the stopper was removed from the flask to allow the sample to escape. A spectrum was recorded with a 20 ms ion introduction as shown in FIG. 5C. The protonated molecule $[M+H]^+$(m/z 125) and proton-bound dimer $[2M+H]^+$(m/z 249) were observed. Good signal-to-noise ratio was obtained for the analysis of this sample at a concentration of 50 ppb. In another experiment, a signal-to-noise ratio of 50 was observed for an air sample containing 10 ppb DMMP, based on which the LOD is estimated to be below 1 ppb.

Figure 6:
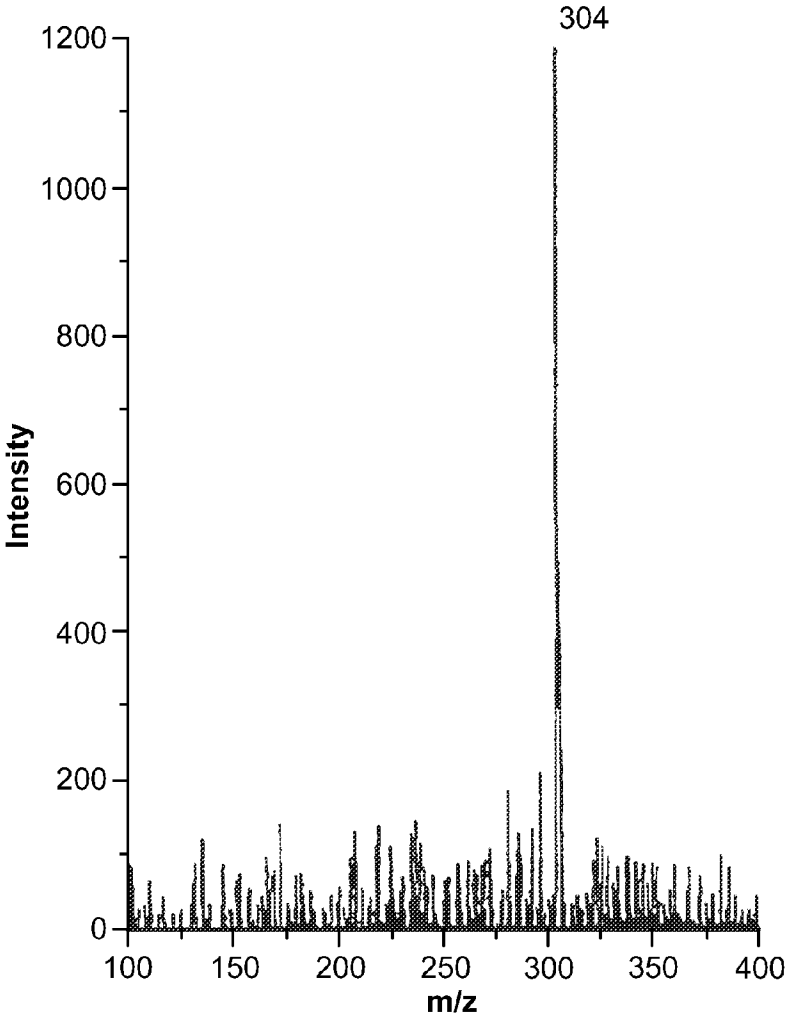
FIG. 6 is a DESI mass spectrum of cocaine on Teflon surface with 15 ms ion introduction time and 500 ms cooling time, background subtracted.

As a demonstration of the use of the discontinuous API for the direct ambient sampling methods, a DESI source was set up for analysis of samples directly from surfaces. A sample was prepared by depositing 5 μl methanol/water (1:1) solution containing 5 ppm cocaine onto a 2×3 mm area on a Teflon surface. After the sample had dried in air, it was analyzed using Mini 10 with DESI and the discontinuous API. Methanol water solvent at a ratio of 1:1 was sprayed at a flow rate of 10 ml/min with a spray voltage of 3 kV to generate the sampling charged droplets. A spray angle of 55° and a take-off angle of 10° were applied and a sheath gas pressure 120 psi was used. The distance between the spray tip and the Teflon surface is about 2 mm and the sampling area was estimated to be 1 $mm^2$. The sample area and a blank area on the Teflon surface were analyzed with 15 ms ion introduction and the spectrum recorded for latter was used for background subtraction. The solid cocaine on surface was desorbed and ionized by DESI and the protonated molecule m/z 304 was observed (FIG. 6).

Figure 7A:
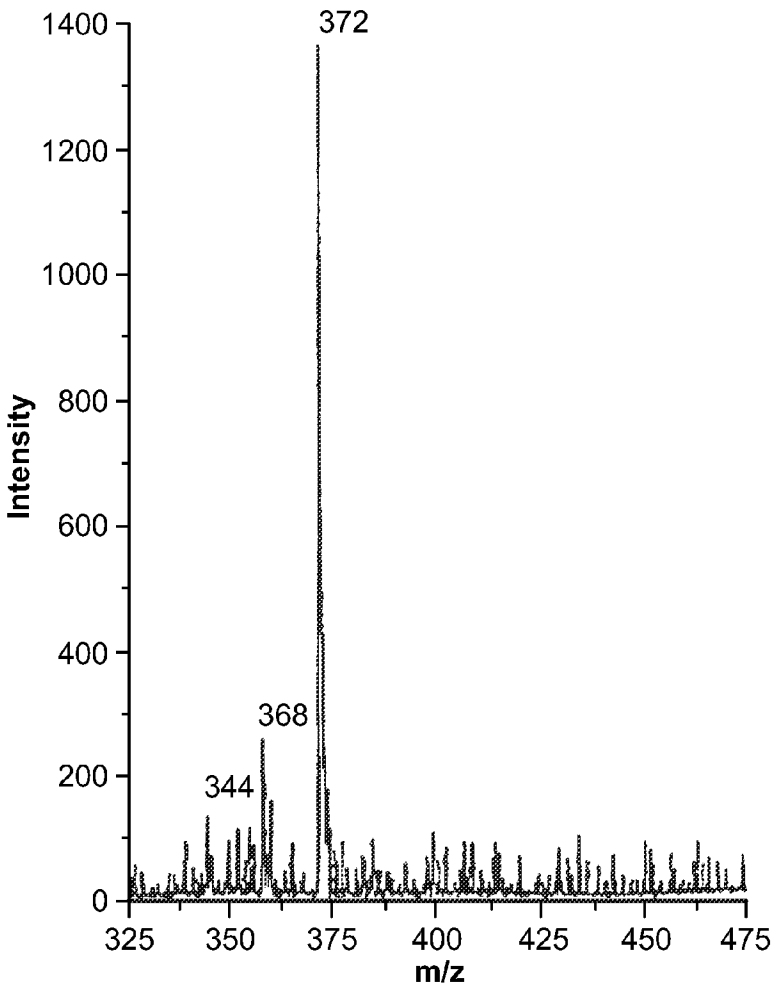
FIG. 7A is a DESI mass spectrum of direct analysis of black ink from BIC Round Stic ballpoint pen.
Figure 7B:
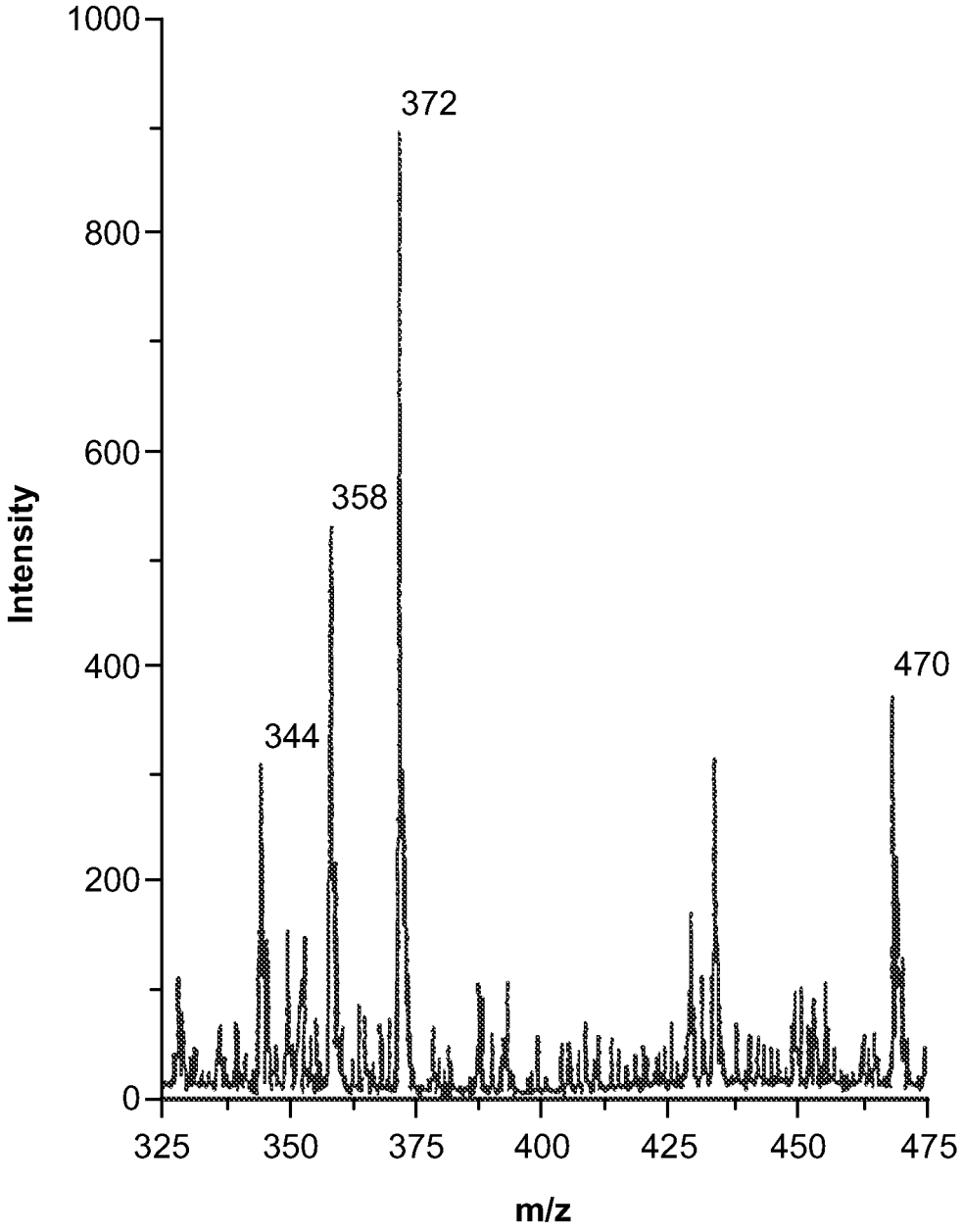
FIG. 7B is a DESI mass spectrum of direct analysis of blue ink from BIC Round Stic ballpoint pen.

Direct ink analysis from surface was also carried as a demonstration of the fast in-situ analysis using an instrument package of DESI, discontinuous API and Mini 10. Two 2 mm×3 mm dots were drawn on a piece of printer paper (Xerox Corporaton, Rochester, N.Y.) using BIC Round Stic black ball pen and blue ball pen, respectively. The experimental condition for DESI was identical to that described above except the methanol water ratio of the solvent was 9:1. The two sample areas on the paper were analyzed with a 15 ms ion introduction and the spectra were recorded as shown in FIG. 7. Basic violet 3, corresponding to the peak m/z 372, was found in the black ball pen ink (FIG. 7A) while both basic violet 3 and basic blue 26 (m/z 470) were found in the blue ball pen ink (FIG. 7B). The peak m/z 358 and 344 observed for both black and blue ball pen ink were reported to be the products of oxidative demethylation of basic violet 3. (Ifa, D. R.; Gumaelius, L. M.; Eberlin, L. S.; Manicke, N. E.; Cooks, R. G. *Analyst* 2007, 132, 461-467; Grim, D. M.; Siegel, J.; Allison, J. J. *Forensic Sci.* 2002, 47, 1265-1273).

Various arrangements of a discontinuous atmospheric pressure interface can be used to transfer ions between two regions at different pressures that opens to allow ions to be transferred and shuts off after the ion transfer to allow different pressures to be established thereby achieving high efficiency ion transfer between differential pressure regions with limited pumping capacity.

Figure 13:
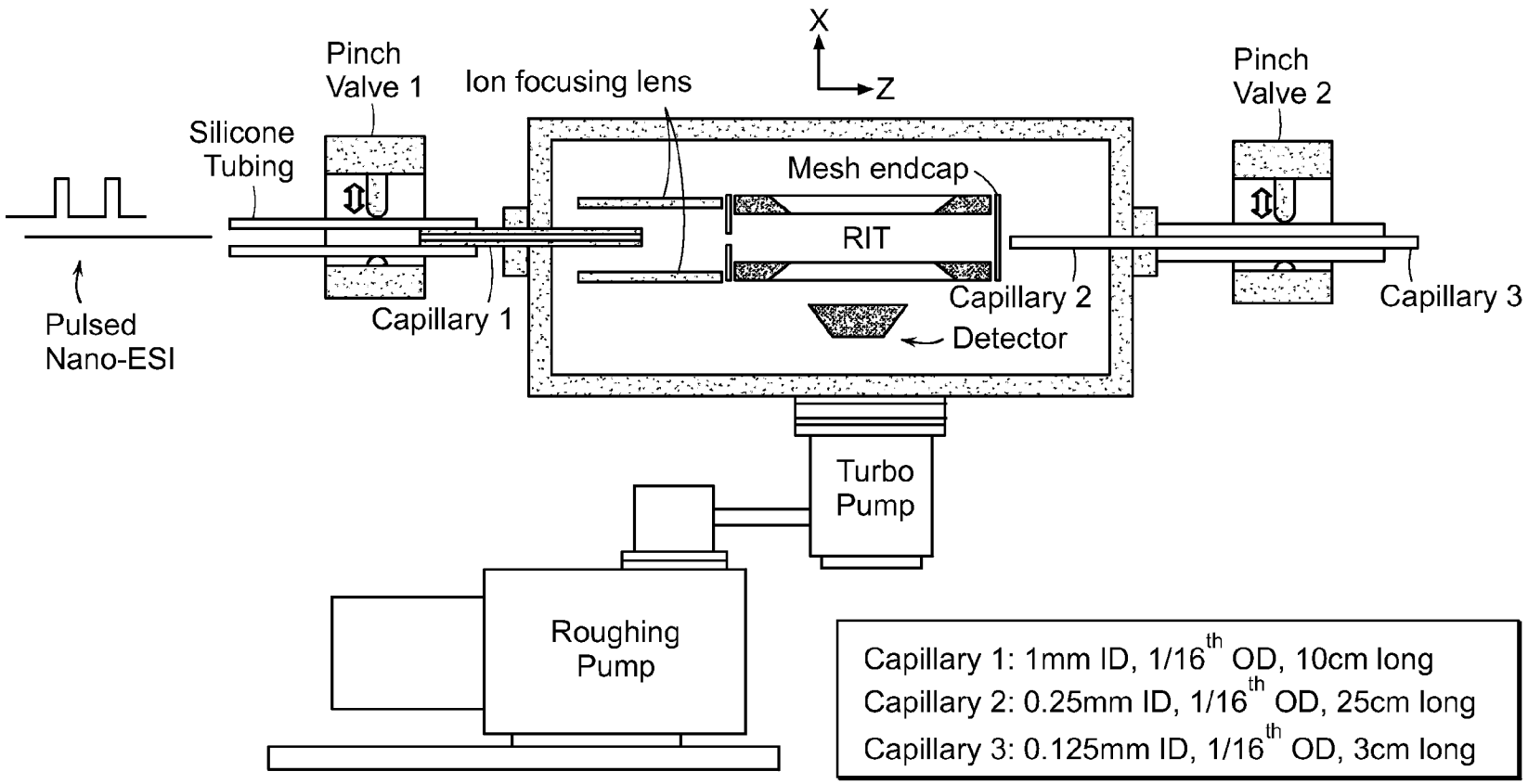
FIG. 13 is a schematic view of a dual discontinuous atmospheric pressure interfaced ion trap mass spectrometer which uses a rectilinear ion trap (DAPI-RIT-DAPI).

Another embodiment is shown in FIG. 13, which consists of a pulsed nano-ESI source and two DAPI interfaced ion trap mass spectrometer, which uses a rectilinear ion trap (RIT) as the mass analyzer. The whole system is controlled by a central computer.

A 10×8×40 $mm^3$ rectilinear ion trap is placed in a 35×25×25 $cm^3$ vacuum chamber to serve as the mass analyzer. The RIT has a stainless steel endcap on one side (left side in FIG. 13) with an ion introduction hole ($1/16^{th}$ inch in diameter) and mesh electrode on the other side. The mesh electrode has a grid size about 1 mm.

The embodiment shown in FIG. 13 has a vacuum chamber with one pressure stage, and two DAPI interfaces are used to maintain the base pressure inside the vacuum chamber. The first DAPI interface is on the left side of the RIT. Capillary 1 connects the vacuum chamber with a 3 cm long silicone tubing (~350 Ohm resistance, with $1/16^{th}$ inch ID and $1/8^{th}$ inch OD). Pinch valve 1, purchased from ASCO Scientific (Florham Park, N.J.), is then used to control the open and close stages of the silicone tubing. Several different ID capillaries were tested, including 125 mm, 250 mm, 1 mm and 1.5 mm ID capillaries with the same length (10 cm). The 1 mm ID capillary (capillary 1) is chosen for the current setup. Capillary 2, pinch valve 2 and capillary 3 constitute the second DAPI interface on the right side of the RIT.

A single phased RF (910 kHz) is applied on the pair of electrodes without ejection slits (y electrodes, FIG. 13), and the dipolar resonance ejection AC (244 kHz with q=0.685, otherwise specified) is applied on the pair of electrodes with ejection slits (x electrodes, FIG. 13). A 120 V DC is also applied on the endcaps to provide additional trapping field along the z direction.

A high voltage DC power supply, a fast, high voltage solid state switch and a nano-ESI needle comprise the pulsed nano-ESI source. 205B-05R purchased from Bertan (Hicksville, N.Y.), which can provide a DC voltage up to 5 kV, is used as the high voltage DC power supply. The high voltage solid state switch is a PVX-4140 high voltage pulse generator purchased from Directed Energy Inc. (Fort Collins, Colo.). The PVX-4140 can output a flat single ended pulse from ground to +/−3500 V with the pulse rise and fall time less than 25 ns. To make the nano-ESI needle, 0.85 mm ID (inner diameter), 1.5 mm OD (outer diameter) glass capillaries are pulled by the P-97 flaming/brown micropipette puller (Sutter Instrument Co. Novato, Calif.) to give a tip diameter from 1 to 10 um.

The pulsed nano-ESI sprays can then be generated. First a constant 2.5 kV DC voltage is generated by the high voltage DC power supply, and then this high DC voltage is outputted to the PVX-4140 switch. The PVX-4140 can be triggered by a low voltage pulse signal. When a 4-6 V pulse signal is sent into the gate of the PVX-4140, a high voltage pulse with the same width will be generated and outputted. The voltage of this output pulse is determined by the high voltage input of the PVX-4140, which is 2 kV in our case. This high voltage pulse is then connected to the nano-ESI needle to have the pulsed nano-ESI sprays.

Figure 14:
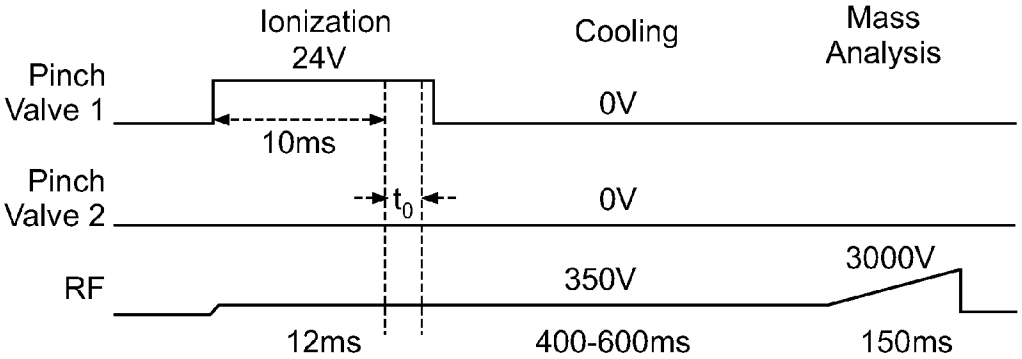
FIG. 14 is a horizontal time graph of a scan function used for the DAPI-RIT-DAPI mass spectrometer.
Figure 15:
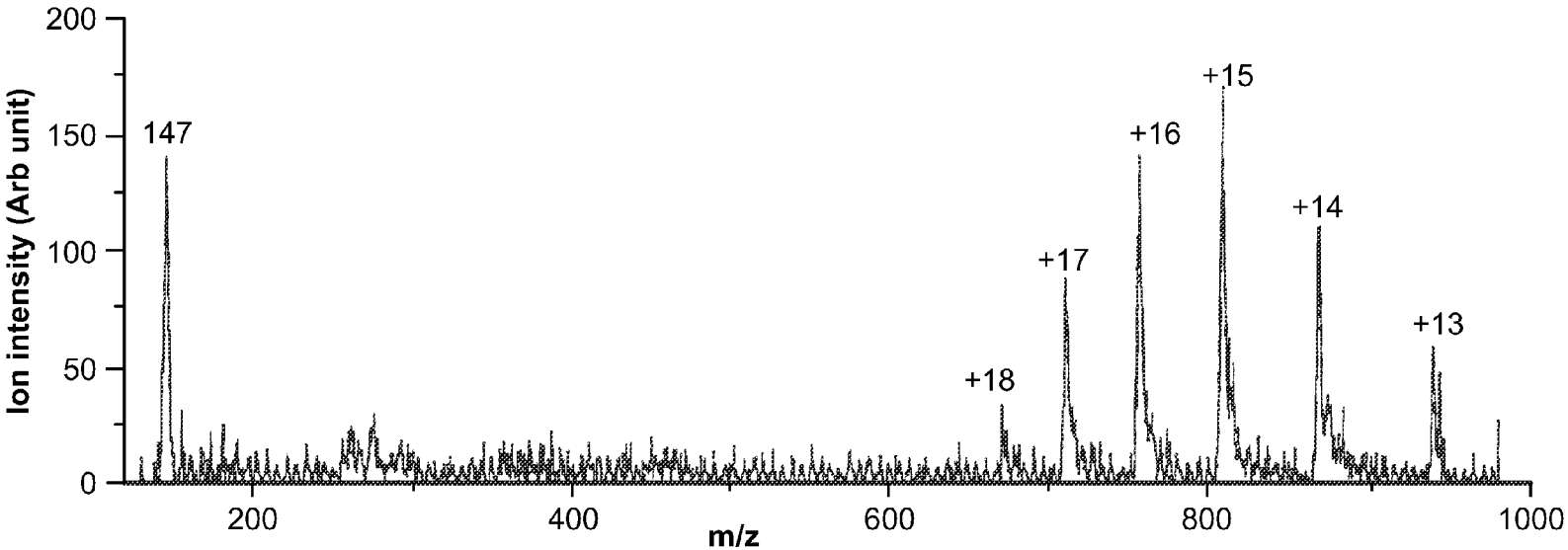
FIG. 15 is a mass spectrum of a Lysine/Cytochrome C mixture recorded using a DAPI-RIT-DAPI mass spectrometer.

The pulsed nano-ESI source, DAPI and waveforms on the ion trap are synchronized and controlled by the central computer. The scanning function consists of three parts: a 12 ms ionization period, a 400 to 600 ms cooling period and a 150 ms RF scanning period (FIG. 14). A 24 V, 12 ms control signal pulse is sent from the computer to pinch valve 1 to open the silicone tubing during the ionization period to let analyte ions/molecules in, while pinch valve 2 is kept closed all time (unless specified). The pulsed nano-ESI source is enabled for a short time of period ($t_e$) during this 12 ms to ionize and spray a very small amount of analytes. The pinch valve open time and the ion source enable time are synchronized and optimized, so that maximum ion transfer efficiency is achieved, resulting in a 10 ms delay of the pulsed nano-ESI with respect to the pinch valve open time. The duration of the pulsed nano-ESI ($t_e$) can be controlled and varied from 300 ns to 3 ms. FIG. 15 shows a mass spectrum obtained from 4 ng/uL Lysine and 300 ng/uL Cytochrome C mixture, with a 500 us nano-ESI pulse.

Different pumping systems are also tested and optimized. The pressure inside the vacuum chamber will increase (>>10 mTorr) when the pinch valve is opened for a short time. To perform mass analysis in RIT, mTorr range of pressure is preferred, so a pumping system which can quickly pump down the vacuum chamber is desired. Three different pumping systems are tested to find the best combination of turbo and roughing pumps. The use of a 30 $m^3$/h roughing pump (Pfeiffer UNO-030M) together with a 345 l/s turbo pump (TurboVac 361); a 307 $m^3$/h roughing pump (Edwards 275 E2M275) together with a 345 l/s turbo pump and a 307 $m^3$/h roughing pump together with two turbo pumps, 345 l/s and 210 l/s (Pfeiffer TMH262P) are tested (see FIG. 16A). In all cases, pinch valve 1 is opened for 12 ms, while keeping pinch valve 2 closed all time. Then the pressure inside the vacuum chamber is monitored by a MKS 925C microPirani transducer (MKS Instrument, Andover, Mass.). Measured results show that the three pumping systems provide very similar characteristic pressure drop curves with respect to time. As shown in FIG. 16, after pinch valve 1 is closed, it takes about 300 ms to pump the pressure down to 2 mTorr, and the pressure drop will be much slower after 2 mTorr in all cases. The 30 $m^3$/h roughing pump (Pfeiffer UNO-030M) together with a 345 l/s turbo pump (TurboVac 361) is chosen as the pumping system in the embodiment depicted in FIG. 13.

By using the ideal gas law (Equation 1), more than 59 micro-mole of air (together with trace amount of analyte molecules/ions) will be sucked into the vacuum chamber during the pinch valve open time.

$$n = \frac{pV}{RT} \qquad \text{Equation 1}$$

n is the amount of gas, p is the absolute pressure of the gas, V is the volume of the gas, R is gas constant and T is the absolute temperature. Also, when the gas mixture entered the vacuum chamber, big expansion of the gas flow is expected to happen at the capillary exit due to the high pressure difference. Gas dynamic simulation in ANSYS (Canonsburg, Pa.) shows this expansion effects at different vacuum chamber base pressures. In the simulation, capillary 1 is used to connect the atmosphere and vacuum chamber with a RIT placed inside the vacuum chamber with dimensions kept same as the instrument setup. When the vacuum chamber base pressure is high (10 Torr), streamline plot of the gas velocity shows that relatively big portion of gas will be injected into the RIT through the hole on the endcap. However, when the vacuum chamber base pressure drop down to 400 mTorr, the gas expansion effect will become stronger and smaller portion of the gas can enter the ion trap through the hole on the endcap (FIGS. 16B and C).

To maximize the ion transfer efficiency from the first DAPI into the ion trap, a 4 cm long, 2 cm diameter cylindrical electrode is placed between the capillary and the endcap of the RIT (FIG. 13). With the help of this electrode (will be referred to as the ion focusing lens), better ion transfer efficiency from atmosphere to the RIT is observed through experiment. In the experiment, five mass spectra of 25 ng/uL of atrazine and 25 ng/uL spinosad are recorded for every different voltage on the focusing lens. Results indicate that the focusing lens can significantly improve the ion transfer efficiency, and an optimized voltage (410 V) is found (shown in FIG. 16D).

Figure 16E:
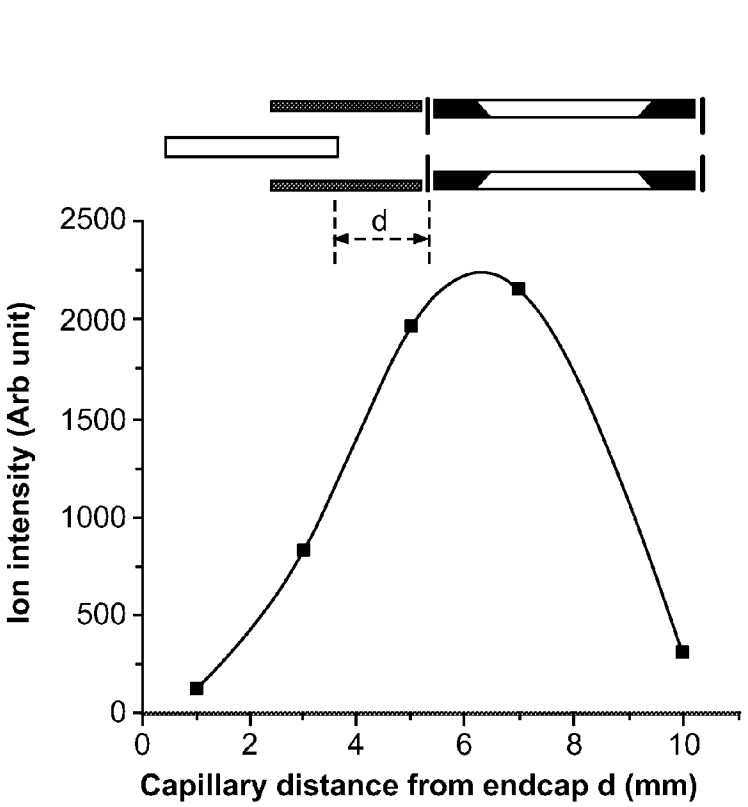
FIG. 16E is the depicts the effect of the distance between capillary 1 and the RIT endcap on ion transfer intensity.
Figure 16D:
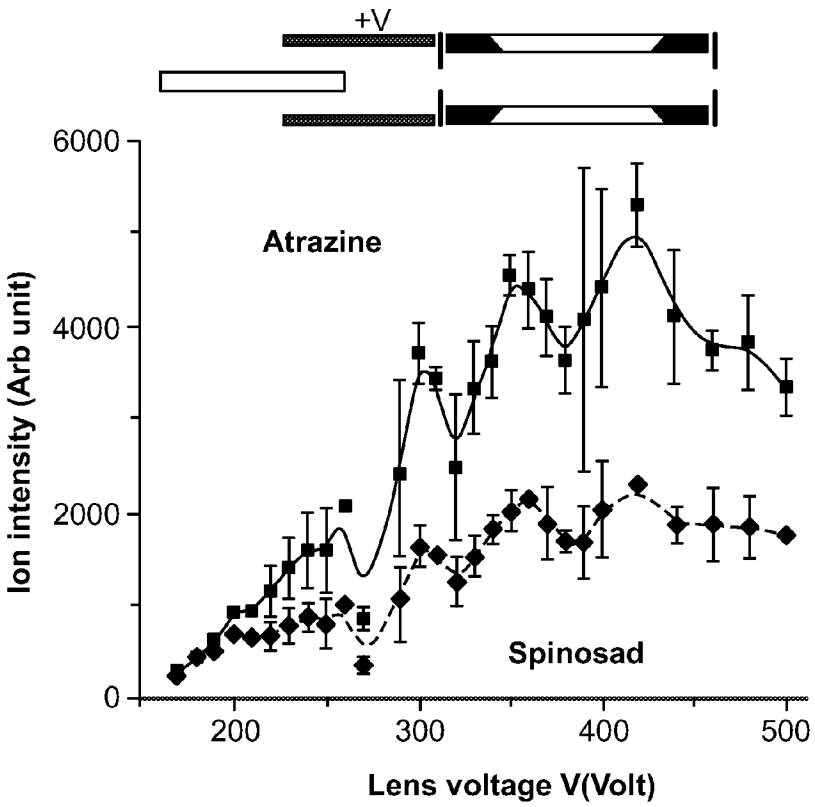
FIG. 16D is the optimization of ion focusing lens voltage.

Capillary 1 is aligned with the holes on the RIT endcaps and its distance from the endcap is optimized too. FIG. 16E depicts the effect of the capillary distance (d) on ion transfer efficiency. In the experiment, 50 ng/uL of bradykinin is used as the analyte. As the capillary distance is varied, the ion focusing lens voltage is also tuned to maximize the ion signal in the mass spectrum. When the capillary is too close to the endcap (<3 mm), ions entering the ion trap will possess high kinetic energy due to gas flow acceleration, which will be hard for the ion trap to capture ions. On the other hand, when the capillary is too far away from the endcap (>1 cm), the gas expansion effect will spread the ion beams into bigger diameter when it reaches the hole on the endcap, which results in lower amount of ions transferred into the ion trap. Therefore, an optimized distance is chosen at around 6 mm.

Figure 17A:
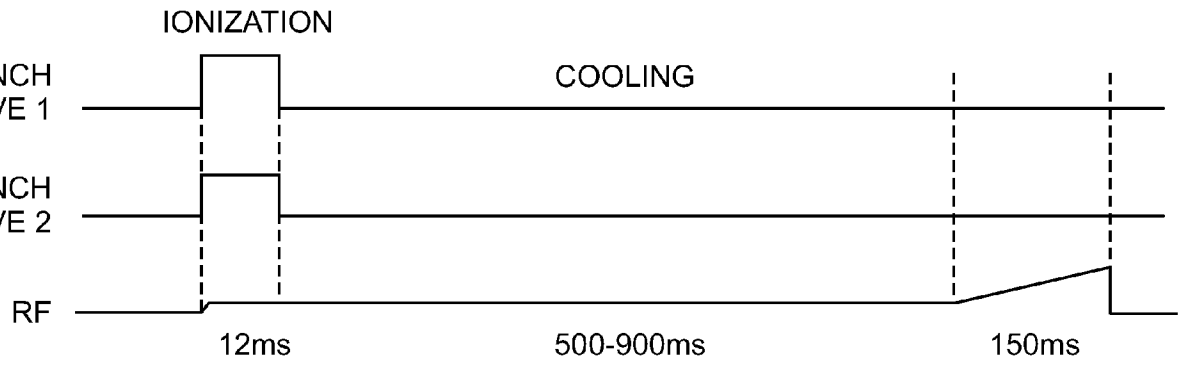
FIG. 17A is horizontal time graph of a scan function used for counter gas flow in the DAPI-RIT-DAPI mass spectrometer.
Figure 17B:
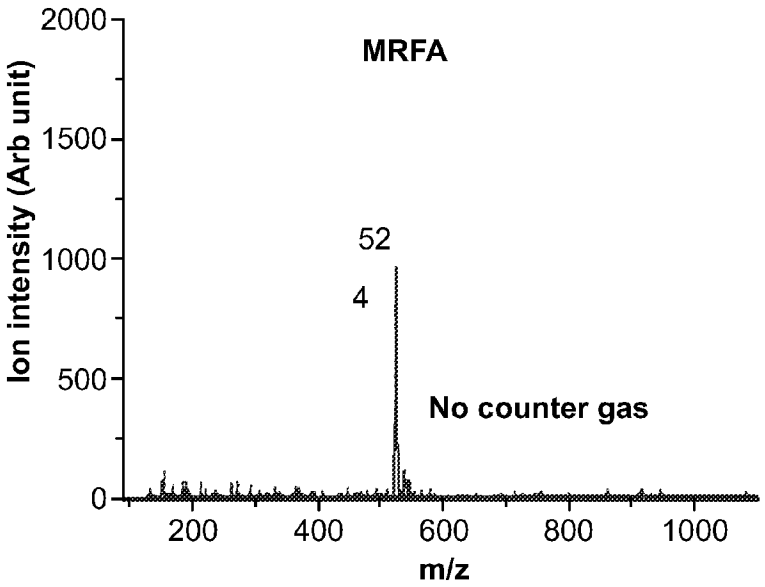
FIGS. 17B-C depict the effects of the counter gas flow on ion capture for MRFA. 17B is with no counter gas and 17C is with counter gas.
Figure 17C:
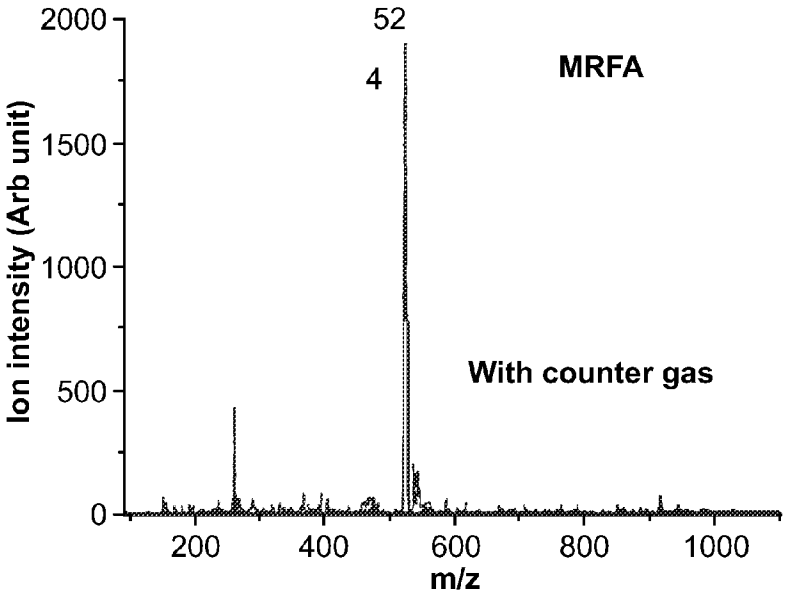

The second DAPI interface was also used to improve the performance of the system. First, pinch valve 2 is opened during the ionization period to increase ion trapping efficiency. When ions are introduced through pinch valve 1, gas flow will accelerate the ion stream and push them into the ion trap. Although the RF and DC potential well are designed to slow down the ions and trap them inside the ion trap, ion molecule collisional cooling also performs important role. By opening pinch valve 2 together with pinch valve 1 during ionization period, a counter gas flow can be formed inside the ion trap. This counter gas flow can effectively reduce the ion stream speed and increase the ion molecule collision probability, which results in a higher ion trapping efficiency. Ion signal intensity can be increased by 2 to 3 times by using this counter gas flow method, which was observed in the chemicals we have tested (10 ng/uL of MRFA, 100 ng/uL of WAGGDApSGE (SEQ ID NO.: 1), 10 ng/uL of bradykinin, mixture of 4 ng/uL lysine and 300 ng/uL cytochrome C) and with the mass spectrum of MRFA shown in FIGS. 17B and C.

Figure 18E:
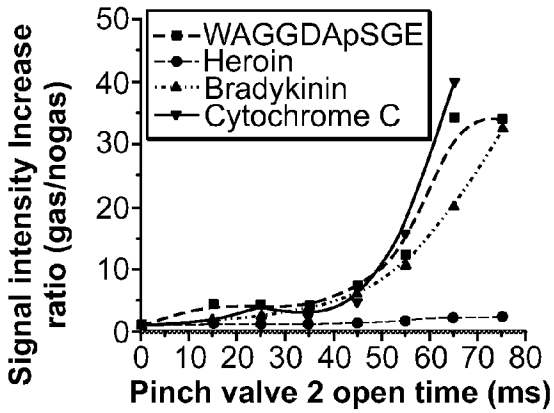
FIGS. 18E-G compare the gas flow effects under various conditions: (18E) different analytes; (18F) with and without isolation before gas flow; and (18G) different amounts analyte sprayed out of the nano-ESI tip.

Pinch valve 2 is also opened during the ion cooling period to improve the ion trapping and desolvation. As plotted in FIG. 18A, pinch valve 2 is opened during the ion cooling period to let the gas blow into the ion trap through the mesh electrode. The ion signal intensity can be increased significantly as this gas blow time increase from 15 to 75 ms. FIGS. 18B-D show a 40 times signal intensity increase by using 100 ng/uL of WAGGDApSGE (SEQ ID NO.: 1). Other chemicals like 50 ng/uL of heroin, 10 ng/uL of bradykinin and 300 ng/uL of cytochrome C were also tested with their signal intensity increase ratio (signal intensity with gas blow over signal intensity without gas blow) plotted in FIG. 18E.

Figure 18F:
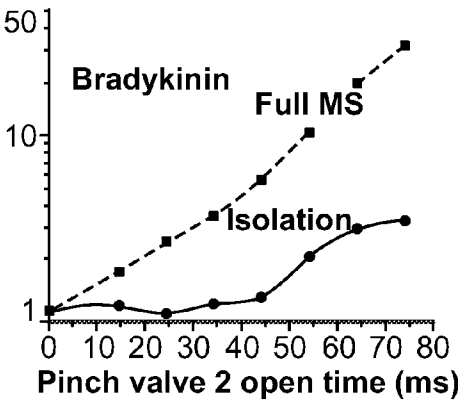

To better understand this gas blow effect, doubly charged bradykinin is isolated first (by using a 30 ms SWIFT waveform with a 10 kHz notch) and then experienced the gas blow. After isolation, the ion intensities are also enhanced by the gas blow (FIG. 18F), which can be assigned to the ion trapping efficiency increase at high pressure. The rest of the ion intensity increase in the full mass spectrum cases may then be assigned to the desolvation effect. After ions and charged solvent clusters are sprayed out of the nano-ESI tip, they experience a relatively short path (<15 cm) before they enter the ion trap. So some charged solvent clusters may not be well desolved, extra gas blow can help the desolvation of these water clusters and improve the ion intensity.

Figure 18G:
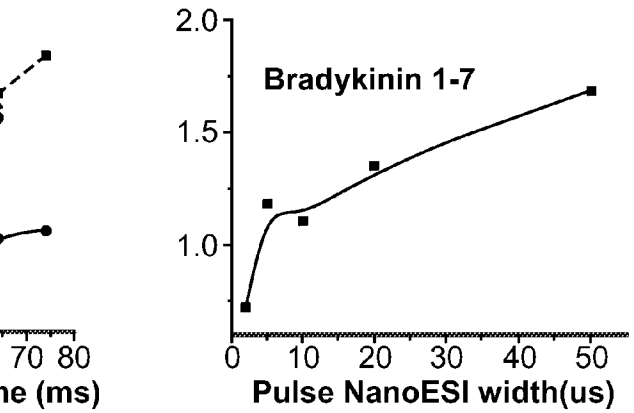

Furthermore, the gas blow effect on ion intensity increase is tested with respect to different amounts of analytes sprayed out of the nano-ESI tip. 100 ng/uL of bradyknin 1-7 is loaded into the nano-ESI tip. By varying the pulse width of the nano-ESI, different amounts of analytes are sprayed into the ion trap. As the amount of analytes decrease, this gas blow effect also decreases as shown in FIG. 18G. First space charge effect will be minimized with very few ions in the trap; second the amount of solvent cluster in the trap may also decrease as the total amount of analytes decrease.

Peptide (bradykinin) and proteins (cytochrome C and myoglobin) are used in the experiments to test the performances of the instrument. Absolute limit of detection for peptide (MS and MS/MS) and mass range extension for large protein are performed.

A 10 ng/uL bradykinin sample is used as an example of peptide detection. 5 uL of the sample is first loaded into the nano-ESI tip. By varying the duration of the nano-ESI pulse, different amount of solutions were sprayed towards the inlet of the mass spectrometer. This amount of sprayed solution is a function of the voltage and duration of the pulse, and it is also a function of the distance of the electrode from the reference ground (in our case the mass spectrometer metal capillary inlet), which is about 1 cm (high voltage probe to the silicone tubing inlet)+3 cm (silicone tubing length).

By applying a high voltage (2.0 kV) pulse from 1 us to 1 ms on a 10 ppm bradykinin solution in the nano-ESI tip, different amount of analytes are sprayed out of the nano-ESI tip. A linear relationship between the amount of sprayed analyte with the pulse width can be assumed. The linear dynamic range with respect to absolute amount for bradykinin is tested from 29 attomole to 2900 attomole (FIG. 19A) (10 us to 1 ms pulse). Five mass spectra were recorded for each data point in FIG. 19A, and the integrate peak area for the doubly protonated bradykinin molecule is calculated. A relatively good linearity range of about 2 orders of magnitude is achieved with a 0.98512 $R^2$ value and standard deviation varies from 5.9%-12.2%.

Figures 19A, 19B, 19C, 19D, 19E, 19F:
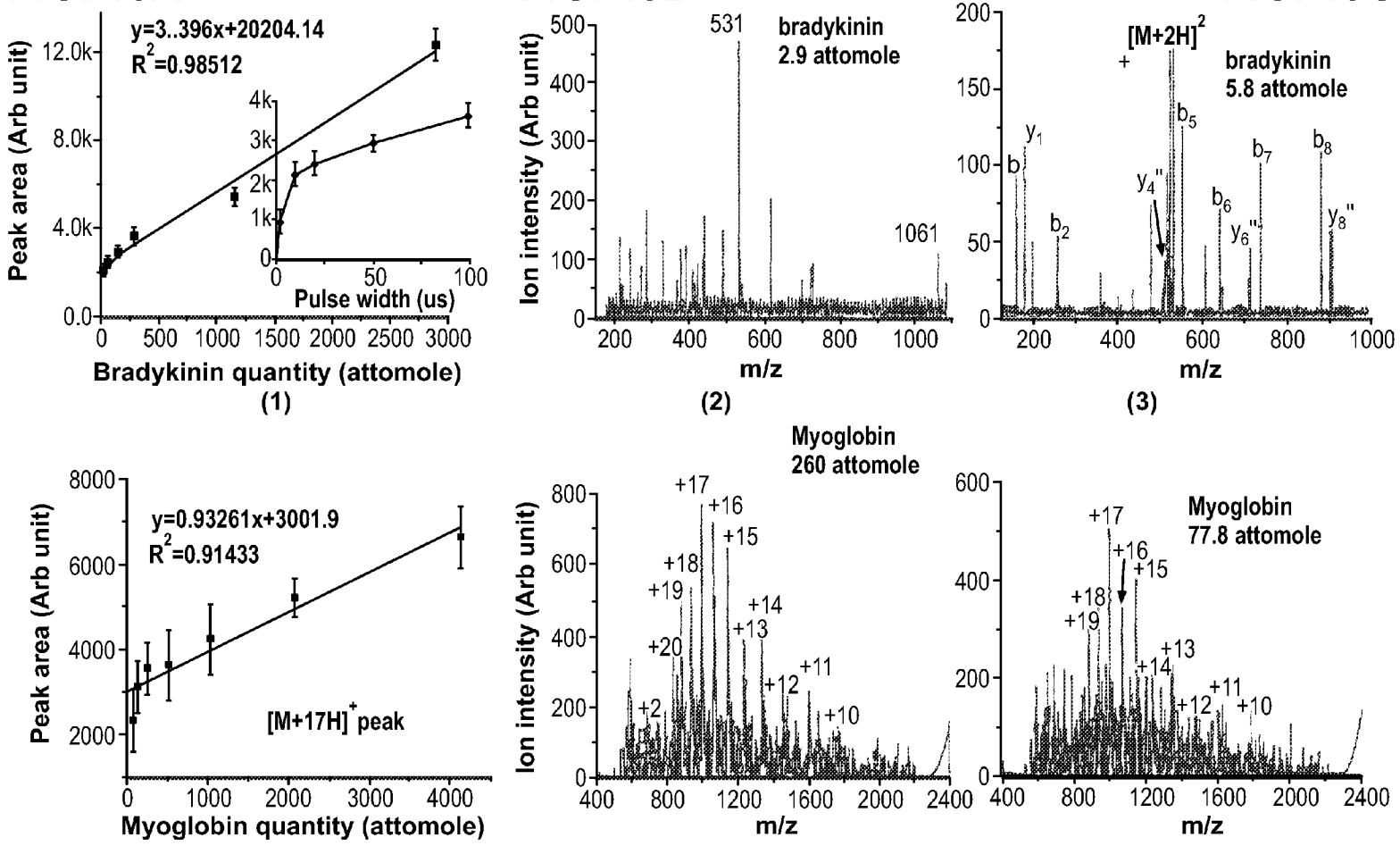
FIGS. 19A-C depict the linear dynamic range of detection for 10 ng/uL bradykinin (19A) as well as the single shot mass spectra for 2.9 attomole (19B) and 5.8 attomole of bradykinin (19C).
FIGS. 19D-F depict the linear dynamic range of detection of 50 ng/uL of myoglobin (19D) as well as the single shot mass spectra for 260 attomole (19E) and 77.8 attomole (19F) of myoglobin.

As the pulse width decrease from 10 us to 1 us, the linearity of the signal intensity versus pulse width changes as shown in the inset of FIG. 19A, and the signal intensity decrease much faster. If we assume the nano-ESI tip has the same spray speed (pL/us) in this time range (1 to 10 us) as in the 10 us to 1 ms time range, about 0.29 pL of the solution will be sprayed out of the tip for a 1 us pulse. FIG. 19B shows the mass spectrum obtained for 2.9 attomole (1 us pulse) bradykinin without any data processing such as averaging, smoothing or filtering. For bradykinin, doubly protonated molecule ($[M+2H]^{2+}$, m/z 531) shows the dominant peak in the mass spectrum, singly charged molecule ($[M+H]^{1+}$, m/z 1060) can also be observed (FIG. 19B). The doubly protonated peak has a signal to noise ratio about 2.5.

The MS/MS capability is an important tool for indentifying biomolecules from complex mixtures. The low absolute amount MS/MS capability of the instrument is also demonstrated by using bradykinin (FIG. 19C). First, 5.4 attomole of bradykinin (2 us pulse) is sprayed by the nano-ESI tip towards the inlet of the mass spectrometer. After ions are trapped in the RIT, a SWIFT (stored waveform inversion Fourier transform) waveform with an 8 kHz wide isolation window is used to isolate the doubly protonated bradykinin molecule. During the ion excitation and CID period, the RF voltage is set on a value such that the m/z 531 ions experience a $q_z$ value of 0.25. A single frequency AC signal with amplitude 1.13 V is then applied for 80 ms to excite parent ions (m/z 531) and induce CID via collisions with background air molecules. The fragmented y" and b ions are observed and shown in FIG. 19C.

To analyze larger proteins, the mass range of the system is extended to 2000. This is done by first elevate the trapping voltage of the RF signal from 350 V to 550 V during the ionization and cooling periods. During the mass analysis period, the dipolar resonance ejection AC signal frequency is also lowered from 244 kHz (q=0.685) to 115 kHz (q=0.35).

To explore the performance of the new setup, 50 ng/uL myoglobin (molecular weight 16700 daltons) sample is tested. FIG. 19D shows the linear response of myoglobin (by using the $[M+17H]^+$ peak for ion intensity calculation) from 77.8 to 4150 attomole with a 0.91433 $R^2$ value. The mass spectrum of 260 attomole myoglobin (500 us pulse) (apomyoglobin groups) is plotted in FIG. 19E with a good signal to noise ratio. By shortening the pulsed nano-ESI ionization time, less amount of myoglobin solution can be sprayed and the ALOD of the new setup for myoglobin can be studied. As low as 77.8 attomole myoglovin (150 us pulse) can be identified with the mass spectrum obtained and plotted in FIG. 19F.

Figures 20E, 20F, 20G:
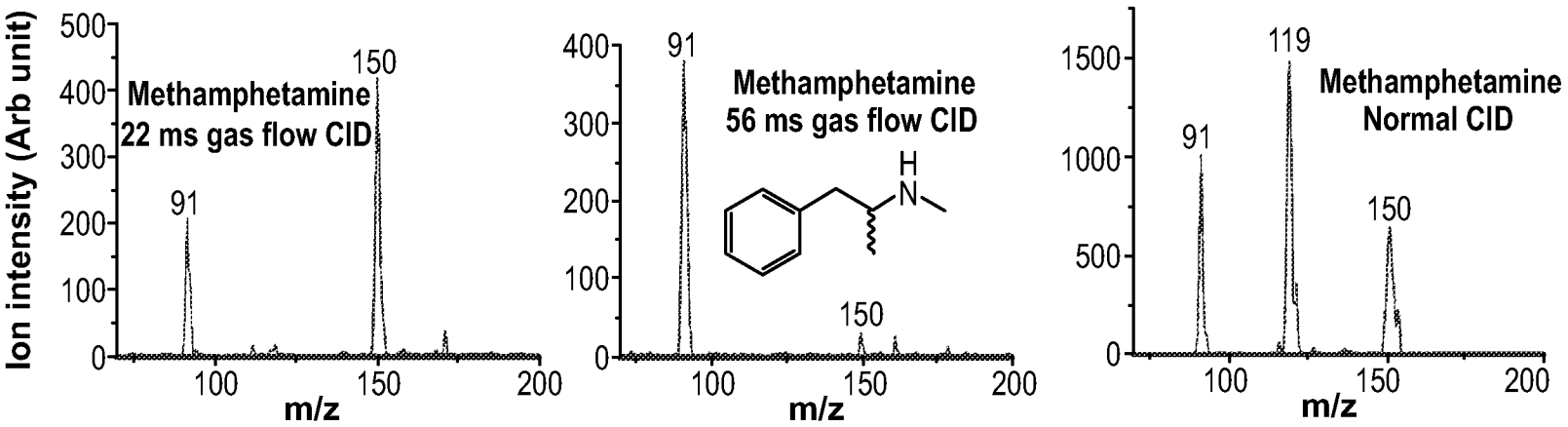
FIGS. 20E-G depict tandem mass spectra for 5 ng/uL of methamphetamine with respect to different gas flow duration and compared to conventional CID. 20E is with 22 ms gas flow, 20F is with 56 ms gas flow, and 20G is with normal CID.

The gas flow can also induce the collisional dissociation for some small organic compounds. For the gas blow CID, pinch valve 2 was opened to let gas flow into the ion trap and induce the ion dissociation (FIG. 20A). First 5 ng/uL of cocaine is isolated and tested under the gas blow CID. Fragmentation peak (m/z 182) can be observed with a 16 ms gas blow (FIG. 20B). As the gas blow duration increases (56 ms; FIG. 20C), the fragmentation efficiency can be improved. To further enhance the fragmentation efficiency, pinch valve 2 can be opened twice (25 ms each time) (FIG. 20D). Opening the pinch valve twice with shorter duration each time can increase the gas blow speed as they enter the ion trap. Because cooling periods in front of each open pinch valve will allow the pumping system to pump down the pressure inside the vacuum chamber, and the gas flow will experience a big pressure difference.

4 ng/uL of methamphetamine is also tested. Methamphetamine can be fragmented easily by this gas blow CID method (FIGS. 20E-G). 56 ms gas blow can achieve over 95% fragmentation efficiency. However, the fragmentation pattern of methamphetamine is different from that in conventional CID, wherein the AC field is used to excite ions for collisional dissociation. The m/z 119 peak which appears in conventional CID mass spectrum does not appear in the gas blow CID spectra.

Ion/molecule and ion/ion reaction capabilities of the setup are also demonstrated. Since the instrument setup has two DAPI interfaces, ion/molecule and ion/ion reactions can be performed. As shown in FIG. 21A, first cations can be introduced into the ion trap through pinch valve 1. After cations are cooled down, anions or reactive molecules can be introduced into the ion trap through pinch valve 2. During and after the anions are introduced into the ion trap, the DC voltage on the endcaps are lowered down to zero to trap both cations and anions.

First an ion/molecule reaction (proton transfer) is demonstrated. 200 ng/uL angiotensin 1 is loaded into a nano-ESI tip put in front of pinch valve 1 and azobenzene crystals in front of pinch valve 2. After angiotensin 1 is ionized and introduced into the ion trap, SWIFT waveform is used to isolate the triply charged cations ($[M+3H]^{3+}$). Then vaporized azobenzene is sucked into the ion trap through pinch valve 2. After about 600 ms cooling time, part of the triply charged angiotensin will lose one proton to azobenzene, and doubly charged angiotensin appeared in the mass spectrum (FIGS. 21B and 21C).

Figure 21D:
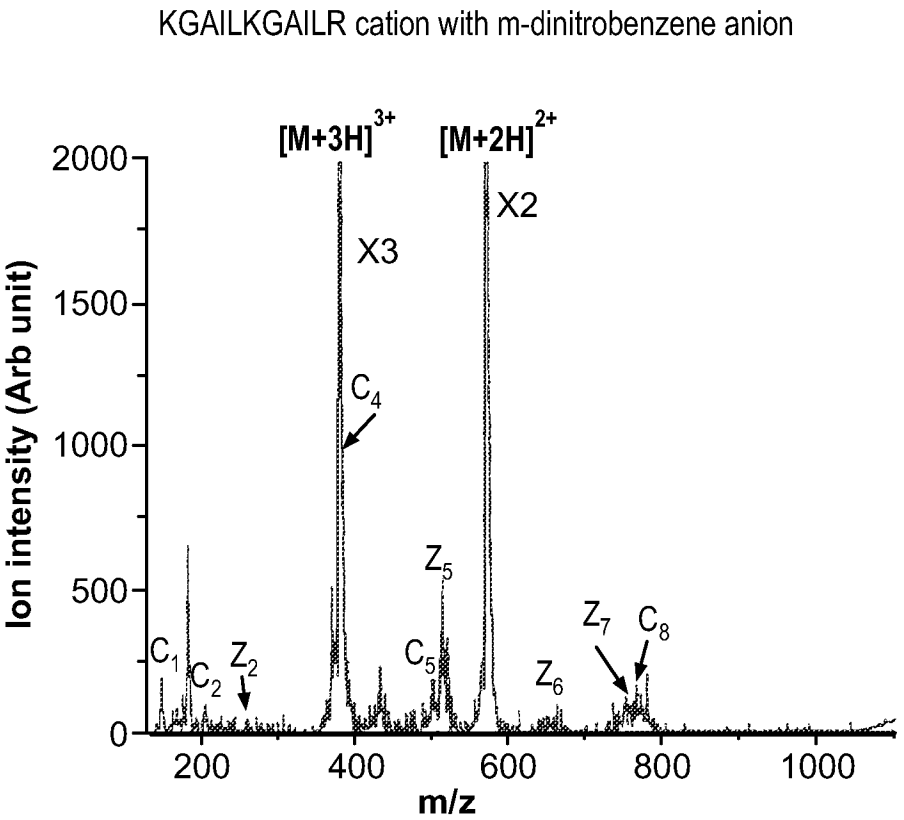
FIG. 21D depicts the electron transfer disassociation between KGAILKGAILR cation and m-dinitrobenzene anion.
Figure 21E:
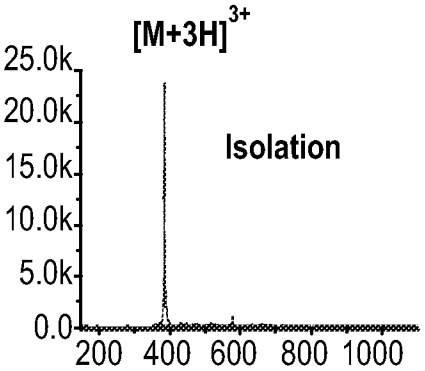
FIG. 21E is a detail of a portion of the spectrum of FIG. 21D.

Ion/ion reaction is performed between 100 ng/uL KGAILKGAILR (SEQ ID NO.: 2) and m-dinitrobenzene. KGAILKGAILR (SEQ ID NO.: 2) is loaded into a nano-ESI tip and put in front of pinch valve 1. A constant −3.2 kV is applied on an atmosphere pressure chemical ionization (APCI) needle which is placed in front of capillary 3. A small bottle of M-dinitrobenzene powder is then placed right under the APCI needle. After triply charged KGAILKGAILR (SEQ ID NO.: 2) is trapped and isolated in the ion trap, m-dinitrobenzene anions will then be sucked into the ion trap through pinch valve 2. During a 900 ms cooling time, both proton transfer and electron transfer dissociation (ETD) happened as shown in FIG. 21D.

Figure 22B:
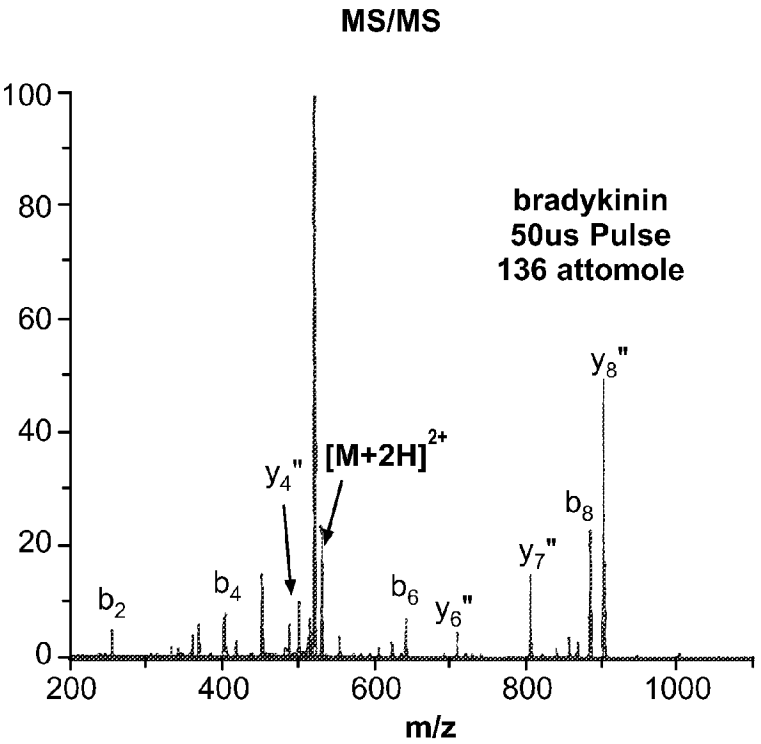
FIGS. 22A-B show the LOD (absolute amount) for LTQ (Thermo, Calif.) mass spectrometer. In the test, pulsed nano-ESI source is coupled with LTQ.
Figure 22A:
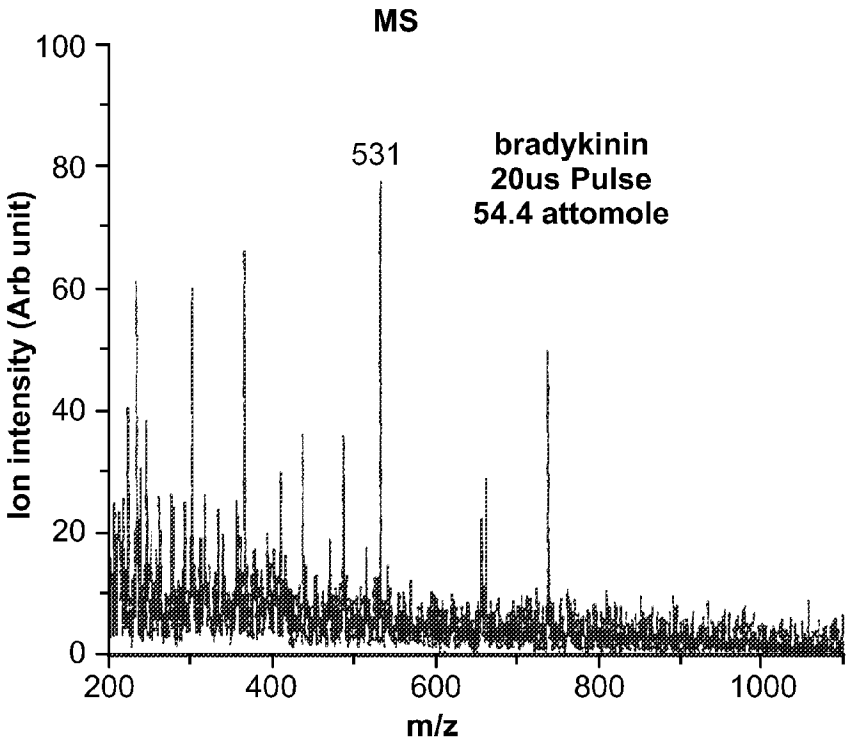

FIGS. 22A-B shows the LOD (absolute amount) for LTQ (Thermo, Calif.) mass spectrometer. In the test, pulsed nano-ESI source is coupled with LTQ. FIG. 22A shows a single MS scan for 54.4 attomole bradykinin (10 ng/uL). FIG. 22A shows a tandom MS scan of 136 attomole bradykinin (10 ng/uL).

Figure 23:
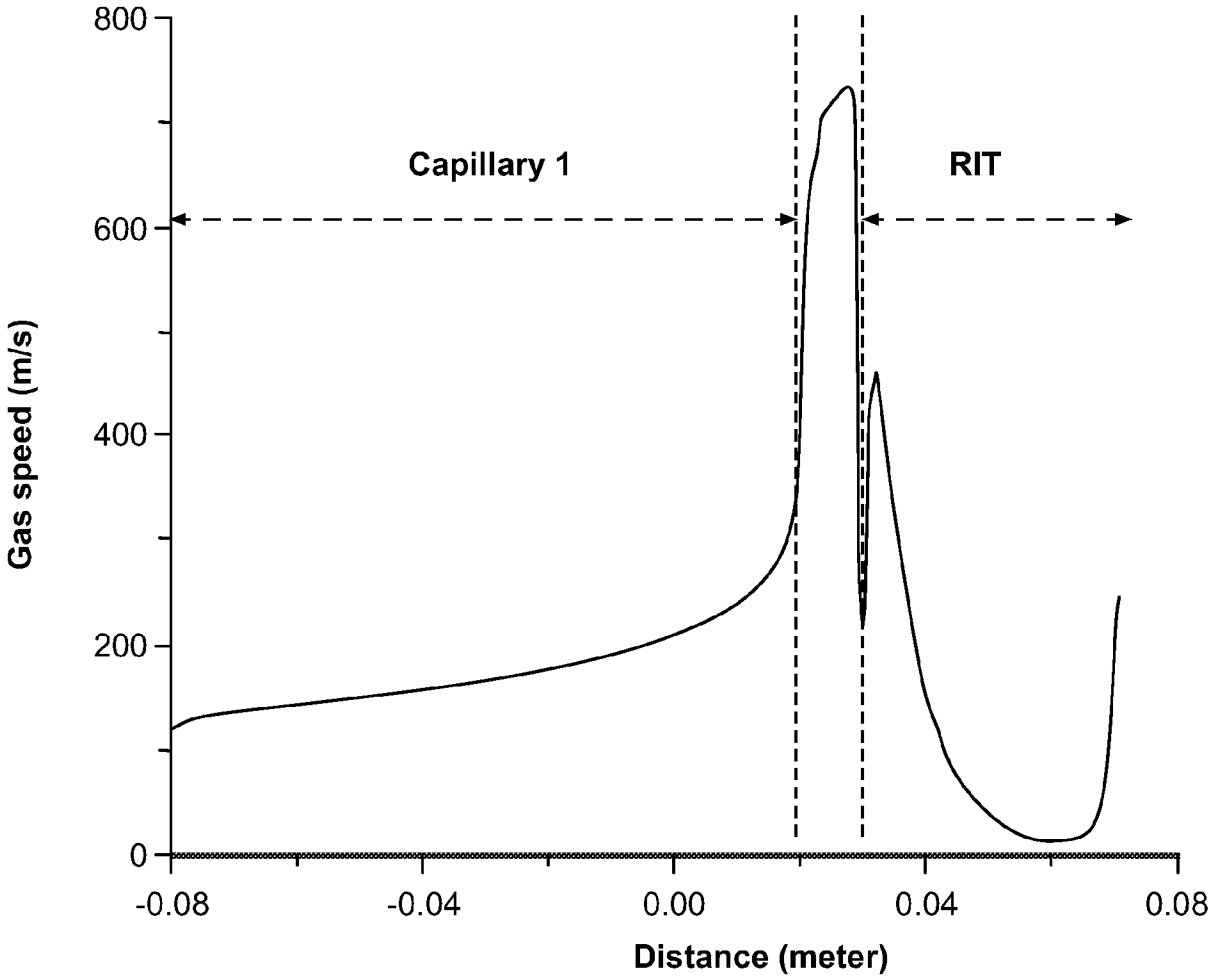
FIG. 23 shows the gas dynamic simulation of gas flow speed from atmosphere to vacuum (0.4 Torr) through capillary 1. Secondary ion acceleration is observed at the hole of the RIT endcap.

FIG. 23 shows the gas dynamic simulation of gas flow speed from atmosphere to vacuum (0.4 Torr) through capillary 1. Secondary ion acceleration is observed at the hole of the RIT endcap.

While these features have been disclosed in connection with the illustrated preferred embodiments, other embodiments of the invention will be apparent to those skilled in the art that come within the spirit of the invention as defined in the following claims. All references, including issued patents and published patent applications, are incorporated herein by reference in their entireties.

2. The method according to claim 1, wherein the method further comprises generating the sample ions using an ionizing source.

3. The method according to claim 2, wherein the ionizing source operates by a technique selected from the group consisting of: electrospray ionization, nano-electrospray ionization, atmospheric pressure matrix-assisted laser desorption ionization, atmospheric pressure chemical ionization, desorption electrospray ionization, atmospheric pressure dielectric barrier discharge ionization, atmospheric pressure low temperature plasma desorption ionization, laser-assisted electrospray ionization, and electrospray-assisted laser desorption ionization.

4. The method according to claim 1, wherein the mass analysis is a tandem mass analysis.

5. The method according to claim 4, wherein the tandem mass analysis is performed without addition of collision gas.

6. The method according to claim 1, wherein discontinuously receiving comprises:

opening a valve of a discontinuous interface, wherein opening of the valve allows for ions to pass through the discontinuous interface to the mass analyzer of the mass spectrometer; and closing the valve.

SEQUENCE LISTING

```
<160> NUMBER OF SEQ ID NOS: 2

<210> SEQ ID NO 1
<211> LENGTH: 9
<212> TYPE: PRT
<213> ORGANISM: Artificial Sequence
<220> FEATURE:
<223> OTHER INFORMATION: Synthetic peptide

<400> SEQUENCE: 1

Trp Ala Gly Gly Asp Ala Ser Gly Glu
1               5


<210> SEQ ID NO 2
<211> LENGTH: 11
<212> TYPE: PRT
<213> ORGANISM: Artificial Sequence
<220> FEATURE:
<223> OTHER INFORMATION: Synthetic peptide

<400> SEQUENCE: 2

Lys Gly Ala Ile Leu Lys Gly Ala Ile Leu Arg
1               5                   10
```

What is claimed is:

1. A method for analyzing a sample, the method comprising:

discontinuously receiving sample ions to a mass analyzer of a mass spectrometer in a manner in which the mass analyzer is periodically open for a period of time that causes the pressure in the mass analyzer to increase above a pressure at which mass analysis or ion manipulation can be conducted and is periodically closed while the mass analyzer is evacuated to a pressure at which mass analysis or ion manipulation can be conducted; and performing mass analysis on the sample ions while the mass analyzer is at a pressure at which mass analysis or ion manipulation can be conducted.

7. The method according to claim 6, wherein a computer synchronizes the opening and the closing of the valve with operation of ion optics of the mass spectrometer.

8. The method according to claim 1, wherein the mass spectrometer is a miniature mass spectrometer.

9. The method according to claim 1, wherein the mass analyzer comprises a linear ion trap.

10. The method according to claim 1, wherein the sample is a biological sample.

11. An analysis system, the system comprising:

an ionization source;

a discontinuous interface operably associated with the ionization source;

a mass analyzer operably associated with the discontinuous interface; and a computer operably connected to the system, wherein the computer contains a processor configured to execute a computer readable program that causes the system to:

open a channel of the discontinuous interface;

apply low RF voltage in the mass analyzer to trap ions in the mass analyzer, the mass analyzer being above a pressure at which mass analysis or ion manipulation can be conducted;

close the channel of the discontinuous interface;

evacuate the mass analyzer to a pressure at which mass analysis or ion manipulation can be conducted; and conduct tandem mass analysis of the ions in the mass analyzer.

12. The system according to claim 11, wherein the discontinuous interface comprises a valve.

13. The system according to claim 12, wherein the program controls the position of the valve in order to open and close the channel of the discontinuous interface.

14. The system according to claim 11, wherein the ionization source is a dielectric barrier discharge ionization source.

15. The system according to claim 11, wherein the mass analyzer is part of a miniature mass spectrometer.

16. The system according to claim 15, further comprising a diaphragm pump operably associated with the mass analyzer.

17. The system according to claim 16, wherein the diaphragm pump is operable at 5 L/min.

18. The system according to claim 11, wherein the mass analyzer comprises a linear ion trap.

* * * * *